US010119341B2

(12) United States Patent
Zhang et al.

(10) Patent No.: US 10,119,341 B2
(45) Date of Patent: Nov. 6, 2018

(54) CUTTER WITH SUPPORT LINER

(71) Applicant: Smith International, Inc., Houston, TX (US)

(72) Inventors: Youhe Zhang, Spring, TX (US); Chen Chen, Houston, TX (US); Yuri Burhan, Spring, TX (US); Jibin Shi, Spring, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 0 days.

(21) Appl. No.: 15/262,896

(22) Filed: Sep. 12, 2016

(65) Prior Publication Data

US 2017/0016281 A1 Jan. 19, 2017

Related U.S. Application Data

(63) Continuation of application No. 14/138,894, filed on Dec. 23, 2013, now Pat. No. 9,464,486.

(60) Provisional application No. 61/746,064, filed on Dec. 26, 2012, provisional application No. 61/789,317, filed on Mar. 15, 2013.

(51) Int. Cl.

| | |
|---|---|
| ***E21B 10/573*** | (2006.01) |
| ***E21B 10/55*** | (2006.01) |
| ***E21B 10/54*** | (2006.01) |
| ***E21B 10/36*** | (2006.01) |
| ***E21B 10/633*** | (2006.01) |
| ***E21B 10/567*** | (2006.01) |
| ***E21B 10/52*** | (2006.01) |

(52) U.S. Cl.

CPC ..... *E21B 10/573* (2013.01); *E21B 10/36* (2013.01); *E21B 10/52* (2013.01); *E21B 10/54* (2013.01); *E21B 10/55* (2013.01); *E21B 10/567* (2013.01); *E21B 10/633* (2013.01)

(58) Field of Classification Search

CPC ..... E21B 10/573; E21B 10/55; E21B 10/54; E21B 10/633; E21B 10/56; E21B 10/36; E21B 10/52

See application file for complete search history.

(56) References Cited

U.S. PATENT DOCUMENTS

| | | | |
|---|---|---|---|
| 5,248,006 | A | 9/1993 | Scott et al. |
| 5,348,108 | A | 9/1994 | Scott et al. |
| 5,533,582 | A | 7/1996 | Tibbitts |
| 5,737,980 | A | 4/1998 | Keith et al. |

(Continued)

FOREIGN PATENT DOCUMENTS

WO 2008128184 A 10/2008

OTHER PUBLICATIONS

International Search Report and Written Opinion issued in corresponding International Application No. PCT/US2013/074865, Mar. 25, 2014, 13 pages.

(Continued)

*Primary Examiner* — Yong-Suk Ro

(57) ABSTRACT

A cutting element assembly includes a sleeve, a lining extending a distance axially from an end of the sleeve, and an inner cutter. The inner cutter has a cutting end, wherein the cutting end extends a depth from a cutting face, a side surface, and a body, wherein the body is at least partially disposed within the sleeve, and wherein the side surface of the cutting end interfaces with an interfacing surface of the lining.

19 Claims, 19 Drawing Sheets

(56) References Cited

U.S. PATENT DOCUMENTS

| | | | | |
|---|---|---|---|---|
| 6,003,623 | A | 12/1999 | Miess | |
| 6,098,729 | A | 8/2000 | Matthias | |
| 6,845,828 | B2 | 1/2005 | Boyce | |
| 7,389,834 | B1 | 6/2008 | Kembaiyan | |
| 7,644,786 | B2 | 1/2010 | Lockstedt et al. | |
| 7,703,559 | B2 | 4/2010 | Shen et al. | |
| 7,757,793 | B2 | 7/2010 | Voronin et al. | |
| 7,997,358 | B2 | 8/2011 | Izaguirre et al. | |
| 8,020,471 | B2 | 9/2011 | Hall et al. | |
| 8,091,655 | B2 | 1/2012 | Shen et al. | |
| 8,109,177 | B2 | 2/2012 | Kembaiyan | |
| 8,210,285 | B2 | 7/2012 | Cooley et al. | |
| 8,235,149 | B2 | 8/2012 | Lockstedt et al. | |
| 8,286,735 | B1 | 10/2012 | Cooley et al. | |
| 8,413,746 | B2 | 4/2013 | Shen et al. | |
| 8,800,691 | B2 | 8/2014 | Shen et al. | |
| 9,033,070 | B2 | 5/2015 | Shen et al. | |
| 2007/0079991 | A1 | 4/2007 | Cooley et al. | |
| 2007/0278017 | A1* | 12/2007 | Shen | E21B 10/5673 175/426 |
| 2008/0223622 | A1* | 9/2008 | Duggan | E21B 10/55 175/432 |
| 2008/0236900 | A1 | 10/2008 | Cooley et al. | |
| 2009/0173548 | A1 | 7/2009 | Voronin et al. | |
| 2010/0314176 | A1 | 12/2010 | Zhang et al. | |
| 2011/0031031 | A1 | 2/2011 | Vempati et al. | |
| 2011/0209922 | A1 | 9/2011 | King et al. | |
| 2011/0297454 | A1 | 12/2011 | Shen et al. | |
| 2012/0273281 | A1 | 11/2012 | Burhan et al. | |

OTHER PUBLICATIONS

Jason Maw, Craig Knull, John Clegg; "Paradigm Shift in Polycrystalline Diamond Bit Design for Canadian Heavy Oil Sands;" SPE, Ulterra Drilling Technologies SPE Heavy Oil Conference Canada, Jun. 12-14, 2012, Calgary, Alberta, Canada, 8 pages.

Aron Deen, Jason Maw, Craig Knull, John Clegg; "Departure From the Norm in Polycrystalline Diamond Bit Design Allows Significant Performance Gains in Highly Erosive and Abrasive Formations;" SPE, Ulterra Drilling Technologies SPE Annual Technical Conference and Exhibition, Oct. 8-10, 2012, San Antonio, Texas, USA, 11 pages.

First Office Action issued in corresponding Chinese Patent Application No. 201380073259.2, dated May 4, 2016, 9 pages.

Second Office Action issued in Chinese Patent Application No. 201380073259.2 dated Dec. 21, 2016, 21 pages.

International Preliminary Report on Patentability issued in International Patent Application No. PCT/US2013/074865 dated Jun. 30, 2015, 11 pages.

Third Office Action issued in Chinese Patent Application No. 201380073259.2 dated Jun. 5, 2017. 17 pages.

Fourth Office Action issued in Chinese Patent Application No. 201380073259.2 dated Oct. 18, 2017. 18 pages.

* cited by examiner

CUTTER WITH SUPPORT LINER

CROSS-REFERENCE TO RELATED APPLICATIONS

This application is a continuation of U.S. patent application Ser. No. 14/138,894, filed Dec. 23, 2013, which application claims the benefit of, and priority to, U.S. Patent Application No. 61/746,064, filed Dec. 26, 2012 and U.S. Patent Application No. 61/789,317, filed Mar. 15, 2013. The foregoing applications are expressly incorporated herein by this reference in their entireties.

BACKGROUND

Drill bits used to drill wellbores through earth formations generally are made within one of two broad categories of bit structures. Depending on the application/formation to be drilled, the appropriate type of drill bit may be selected based on the cutting action type for the bit and its appropriateness for use in the particular formation. Drill bits in the first category are generally known as "roller cone" bits, which include a bit body having one or more roller cones rotatably mounted to the bit body. The bit body may be formed from steel or another high strength material. The roller cones may also be formed from steel or other high strength material and include a plurality of cutting elements disposed at selected positions about the cones. The cutting elements may be formed from the same base material as is the cone. These bits may be referred to as "milled tooth" bits. Other roller cone bits include "insert" cutting elements that are press (interference) fit into holes formed and/or machined into the roller cones. The inserts may be formed from, for example, tungsten carbide, natural or synthetic diamond, boron nitride, or any one or combination of hard or superhard materials.

Drill bits of the second category may be referred to as "fixed cutter" or "drag" bits. Drag bits, include bits that have cutting elements attached to the bit body, which may be a steel bit body or a matrix bit body formed from a matrix material such as tungsten carbide surrounded by a binder material. Drag bits may generally be defined as bits that have no moving parts. However, there are different types and methods of forming drag bits that are known in the art. For example, drag bits having abrasive material, such as diamond, impregnated into the surface of the material which forms the bit body are commonly referred to as "impreg" bits. Drag bits having cutting elements made of an ultra hard cutting surface layer or "table" (such as made of polycrystalline diamond material or polycrystalline boron nitride material) deposited onto or otherwise bonded to a substrate are known in the art as polycrystalline diamond compact ("PDC") bits.

PDC bits drill soft formations easily, but they are frequently used to drill moderately hard or abrasive formations. They cut rock formations with a shearing action using small cutters that do not penetrate deeply into the formation. Because the penetration depth is shallow, high rates of penetration are achieved through relatively high bit rotational velocities.

PDC cutters have been used in industrial applications including rock drilling and metal machining for many years. In PDC bits, PDC cutters are received within cutter pockets, which are formed within blades extending from a bit body, and may be bonded to the blades by brazing to the inner surfaces of the cutter pockets. The PDC cutters are positioned along the leading edges of the bit body blades so that as the bit body is rotated, the PDC cutters engage and drill the earth formation. In use, high forces may be exerted on the PDC cutters, particularly in the forward-to-rear direction. Additionally, the bit and the PDC cutters may be subjected to substantial abrasive forces. In some instances, impact, vibration, and erosive forces have caused drill bit failure due to loss of one or more cutters, or due to breakage of the blades.

In a typical PDC cutter, a compact of polycrystalline diamond ("PCD") (or other superhard material, such as polycrystalline cubic boron nitride) is bonded to a substrate material, which may be a sintered metal-carbide to form a cutting structure. PCD comprises a polycrystalline mass of diamond grains or crystals that are bonded together to form an integral, tough, high-strength mass or lattice. The resulting PCD structure produces enhanced properties of wear resistance and hardness, making PCD materials extremely useful in aggressive wear and cutting applications where high levels of wear resistance and hardness are desired.

An example of a PDC bit having a plurality of cutters with ultra hard working surfaces is shown in FIG. 1. The drill bit 100 includes a bit body 110 having a threaded pin end 111 and a cutter end 115. The cutter end 111 includes a plurality of ribs or blades 120 arranged about the rotational axis L of the drill bit and extending radially outward from the bit body 110. Cutting elements, or cutters, 150 are embedded in the blades 120 at predetermined angular orientations and radial locations relative to a working surface and with a desired back rake angle against a formation to be drilled.

A plurality of orifices 116 is positioned on the bit body 110 in the areas between the blades 120, which may be referred to as "gaps" or "fluid courses." The orifices 116 are commonly adapted to accept nozzles. The orifices 116 allow drilling fluid to be discharged through the bit in selected directions and at selected rates of flow between the cutting blades 120 for lubricating and cooling the drill bit 100, the blades 120 and the cutters 150. The drilling fluid also cleans and removes the cuttings as the drill bit 100 rotates and penetrates the geological formation. The fluid courses are positioned to provide additional flow channels for drilling fluid and to provide a passage for formation cuttings to travel past the drill bit 10 toward the surface of a wellbore (not shown).

A factor in determining the longevity of PDC cutters is the exposure of the cutter to heat. Exposure to heat can cause thermal damage to the diamond table and eventually result in the formation of cracks (due to differences in thermal expansion coefficients) which can lead to spalling of the polycrystalline diamond layer, delamination between the polycrystalline diamond and substrate, and conversion of the diamond back into graphite causing rapid abrasive wear. The thermal operating range of conventional PDC cutters is about 700-750° C. or less.

As mentioned, conventional polycrystalline diamond is stable at temperatures of up to 700-750° C. in air, above which observed increases in temperature may result in permanent damage to and structural failure of polycrystalline diamond. This deterioration in polycrystalline diamond is due to the large difference in the coefficient of thermal expansion of the binder material, cobalt, as compared to diamond. Upon heating of polycrystalline diamond, the cobalt and the diamond lattice will expand at different rates, which may cause cracks to form in the diamond lattice structure and result in deterioration of the polycrystalline diamond. Damage may also be due to graphite formation at diamond-diamond necks leading to loss of microstructural integrity and strength loss, at extremely high temperatures.

In convention drag bits, PDC cutters are fixed onto the surface of the bit such that a common cutting surface contacts the formation during drilling. Over time and/or when drilling certain hard but not necessarily highly abrasive rock formations, the edge of the working surface on a cutting element that constantly contacts the formation begins to wear down, forming a local wear flat, or an area worn disproportionately to the remainder of the cutting element. Local wear flats may result in longer drilling times due to a reduced ability of the drill bit to effectively penetrate the work material and a loss of rate of penetration caused by dulling of edge of the cutting element. That is, the worn PDC cutter acts as a friction bearing surface that generates heat, which accelerates the wear of the PDC cutter and slows the penetration rate of the drill. Such flat surfaces effectively stop or severely reduce the rate of formation cutting because the conventional PDC cutters are not able to adequately engage and efficiently remove the formation material from the area of contact. Additionally, the cutters may be under constant thermal and mechanical load. As a result, heat builds up along the cutting surface, and results in cutting element fracture. When a cutting element breaks, the drilling operation may sustain a loss of rate of penetration, and additional damage to other cutting elements, should the broken cutting element contact a second cutting element.

Additionally, the generation of heat at the cutter contact point, specifically at the exposed part of the PDC layer caused by friction between the PCD and the work material, causes thermal damage to the PCD in the form of cracks which lead to spalling of the polycrystalline diamond layer, delamination between the polycrystalline diamond and substrate, and back conversion of the diamond to graphite causing rapid abrasive wear. The thermal operating range of conventional PDC cutters is about 750° C. or less.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a cutting element assembly that includes a sleeve, a lining extending a distance axially from an end of the sleeve, and an inner cutter. The inner cutter has a cutting end extending a depth from a cutting face, a side surface, and a body at least partially disposed within the sleeve, wherein the side surface of the cutting end interfaces with an interfacing surface of the lining.

In another aspect, embodiments disclosed herein relate to a cutting element assembly that includes a support structure and an inner cutter partially disposed within the support structure. The support structure has a sleeve portion and a lining portion extending a distance axially from the sleeve portion, wherein the support structure has a non-uniform wall thickness. The inner cutter has a cutting end extending a depth from a cutting face, a side surface and a body.

In yet another aspect, embodiments disclosed herein relate to a drill bit that includes a bit body having a plurality of blades extending radially therefrom and at least one cutting element disposed in a cutter pocket formed on the plurality of blades. The cutting element may include a sleeve, a lining extending a distance axially from an end of the sleeve and an inner cutter that has a cutting end extending a depth from a cutting face, a side surface, and a body at least partially disposed within the sleeve, wherein the side surface of the cutting end interfaces with an interfacing surface of the lining.

Other aspects and advantages of the claimed subject matter will be apparent from the following description and the appended claims.

DETAILED DESCRIPTION

In one aspect, embodiments disclosed herein relate to drill bits or other cutting tools having rotating cutting elements disposed thereon and methods for retaining the rotating cutting elements on cutting tools. Such rotating cutting elements may be used as the sole cutting structure on a bit or cutting tool or may be used with conventional cutting structures such as fixed blades (with cutters).

Figure 1:
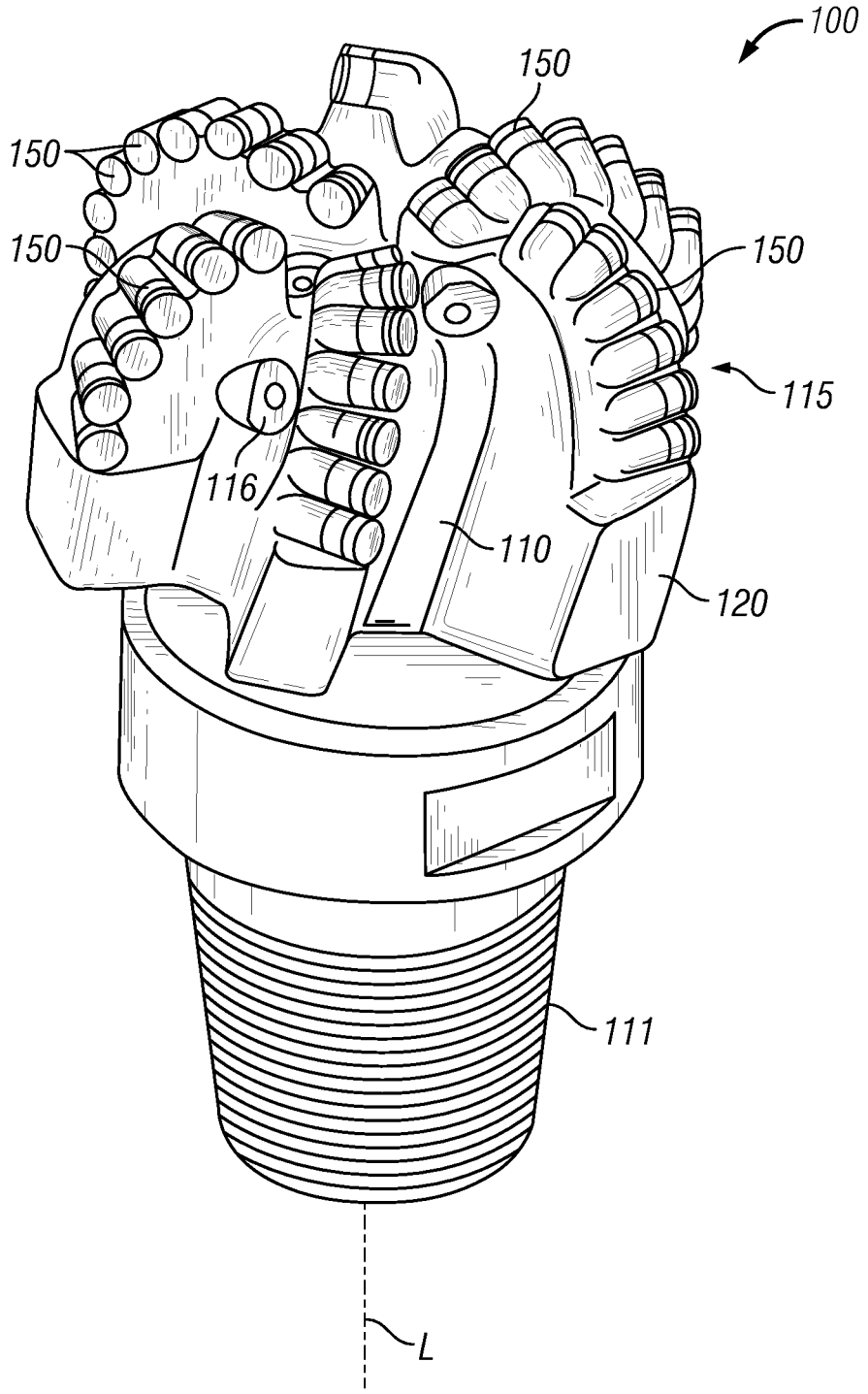
FIG. 1 (Prior Art)
FIG. 1 is a perspective of a conventional PDC drill bit.
Figure 2:
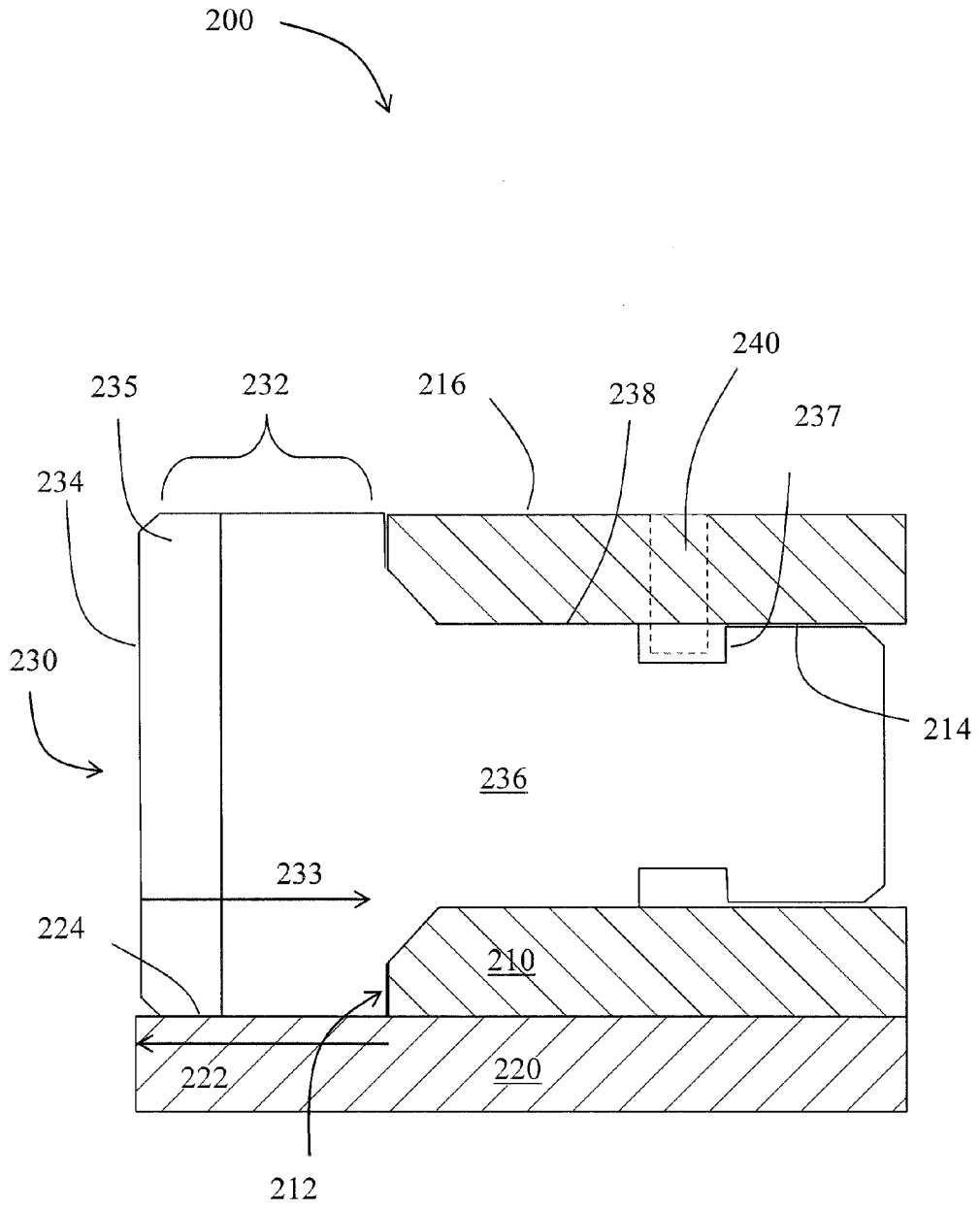
FIG. 2 is a cross-sectional view of a cutting element assembly according to embodiments of the present disclosure.

Referring now to FIG. 2, a cross-sectional view of a cutting element assembly according to embodiments of the present disclosure is shown. The cutting element assembly 200 has a sleeve 210, a lining 220, and an inner cutter 230 assembled together. The inner cutter 230 has a cutting end 232 that extends a depth 233 from a cutting face 234, a body 236 and a side surface 238. The inner cutter 230 may have at least two different diameters, wherein the diameter of the cutting end 232 is larger than the diameter at a portion of the body 236. As shown, the depth 233 of the cutting end 232 may include the entire portion of the inner cutter 230 having the larger diameter, from the cutting face 234 to the first reduction in diameter. In such embodiments, the cutting end 232 may include an ultrahard material, such as a diamond table 235, and a portion of the body material, such as a carbide material. The body 236 of the inner cutter 230 is at least partially disposed within the sleeve 210, and the cutting end 232 is outside the sleeve 210. The sleeve 210 has an inner surface 214 and an outer surface 216. As shown, the portion of the body 236 that is disposed within the sleeve 210 has a diameter that is substantially equal to the inner diameter of the sleeve 210 (measured between the inner surface 214 of the sleeve 210), and the cutting end 232 of the inner cutter 230 has a diameter that is substantially equal to the outer diameter of the sleeve 210 (measured between the outer surface 216 of the sleeve 210). Various geometries such as a gradual slope or a curved surface may form the transition between the larger diameter of the cutting end 232 and the smaller diameter of the body 236 disposed within the sleeve 210. The lining 220 extends a distance 222 axially from an end 212 of the sleeve 210 such that the side surface 238 of the cutting end 232 interfaces with an interfacing surface 224 of the lining 220. As shown, the distance 222 of the lining 220 may be substantially equal to the depth 233 of the cutting end 232. However, in some embodiments, the distance of the lining extending axially from the end of the sleeve may be greater than the depth of the cutting end or less than the depth of the cutting end.

Figure 6:
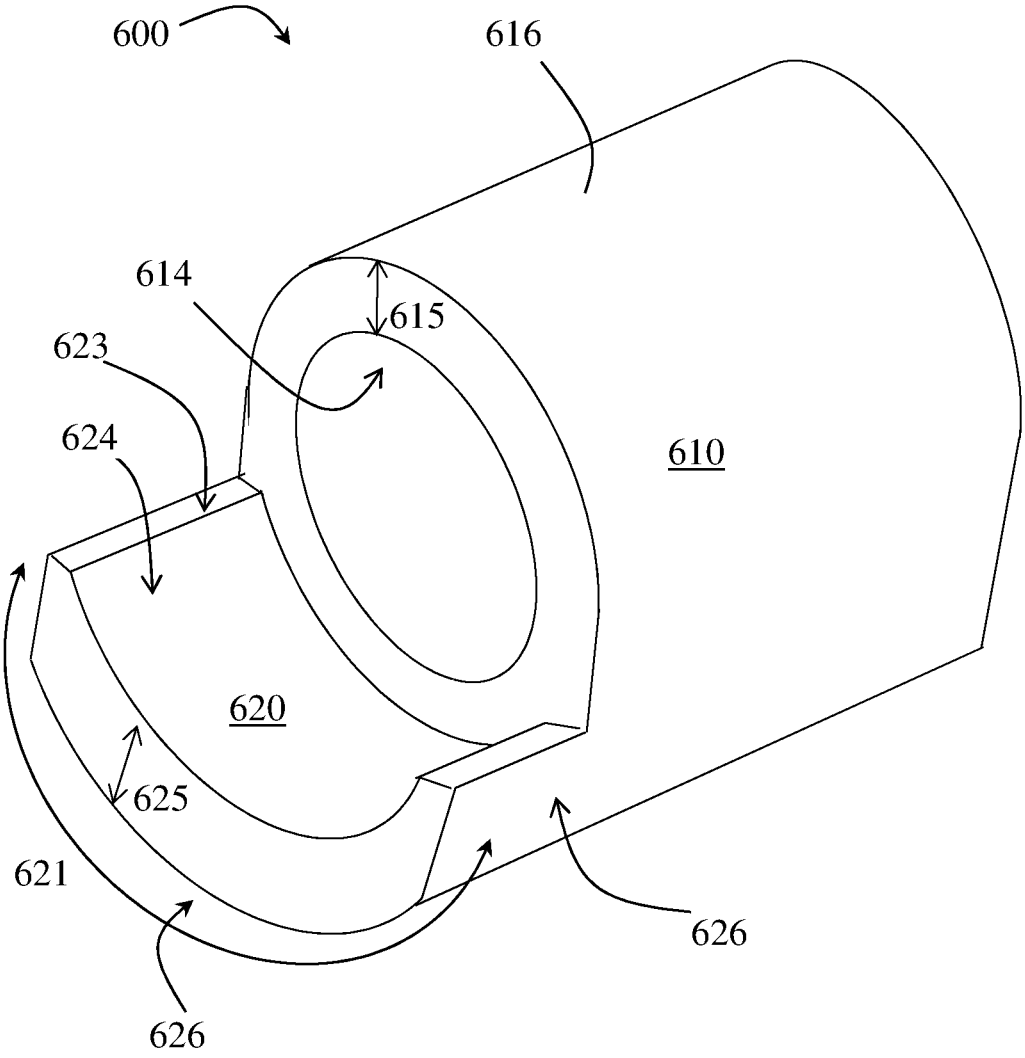
FIG. 6 is a perspective view of a sleeve and lining assembly according to embodiments of the present disclosure.

As shown in FIG. 2, the lining 220 is a separate component from the sleeve 210 and positioned adjacent to the outer surface 216 of the sleeve 210, such that the interfacing surface 224 of the lining 220 interfaces both the side surface 238 of the inner cutter 230 and the outer surface 216 of the sleeve 210. The interfacing surface 224 may have a lubricious material such as diamond or other low-friction material coated along the portion of the lining 220 that extends the distance 222 axially from the end 212 of the sleeve and interfaces the side surface 238 of the cutting end 232 of the inner cutter 230. The lining 220 may be positioned axially along the sleeve 210 such that the lining 220 extends the distance 222 past the end 212 of the sleeve 210 in addition to the entire length of the sleeve 210, a length less than the length of the sleeve 210, or a length greater than the length of the sleeve 210. FIG. 2 shows an example of an embodiment having the lining 220 positioned axially along the sleeve 210 such that the lining 220 extends the distance 222 past the end 212 of the sleeve 210 in addition to the entire length of the sleeve 210. The lining 220 may be brazed or otherwise attached to the sleeve 210. However, according to other embodiments, the lining may be integral with the sleeve, such as shown in FIGS. 3 and 6, described below.

Figure 3:
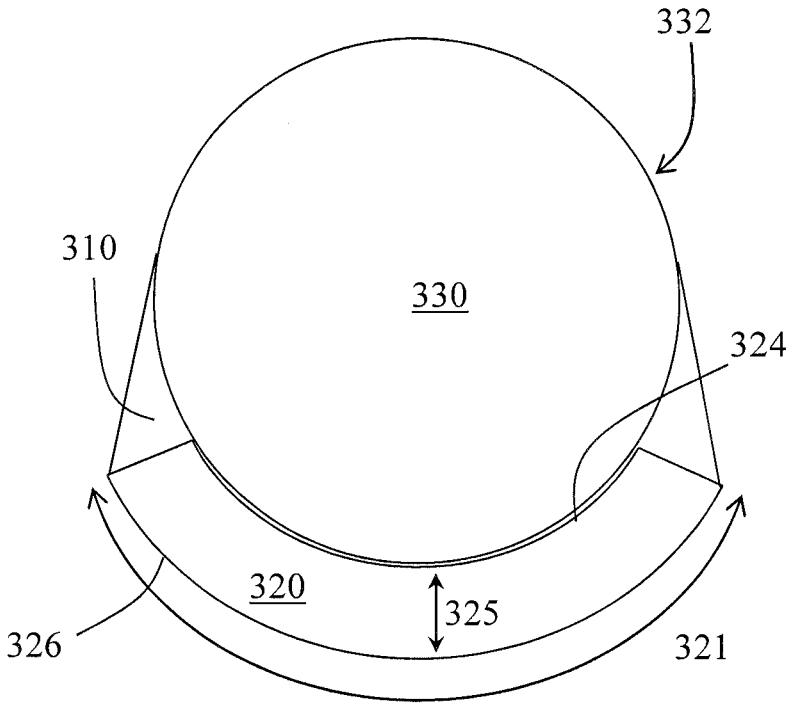
FIG. 3 is a front view of a cutting element assembly according to embodiments of the present disclosure.

Referring now to FIG. 3, a front view of a cutting element assembly according to embodiments of the present disclosure is shown. As shown, an inner cutter 330 is disposed within a sleeve 310 and a lining 320. The sleeve 310 and lining 320 are integrally formed as one piece, wherein the sleeve 310 portion has an outer diameter that is substantially equal to the diameter of the cutting end 332 (positioned axially behind the cutting end 332 in FIG. 3). The lining 320 portion extends a thickness 325 from the sleeve outer diameter/cutting end diameter and a distance axially from the sleeve 310 portion to partially surround the cutting end 332 of the inner cutter. Particularly, the thickness 325 may be measured between an interfacing surface 324 and a base surface 326 of the lining 320, wherein the lining 320 interfaces with the cutting end 332 of the inner cutter 330 at the interfacing surface 324. Further, the lining 320 may extend an arc length 321 around a partial circumference of the cutting end 332. According to some embodiments, the thickness 325 of the lining 320 may be constant along the entire arc length 321. According to other embodiments, the thickness 325 may vary along the arc length 321. For example, the thickness of the lining may decrease towards the ends of the arc length, such as shown in FIG. 6. In embodiments having a constant lining thickness, both the interfacing surface and the base surface of the lining may be curved, corresponding with the radius of curvature of the cutting end of the inner cutter. However, in embodiments having a varying lining thickness, the base surface may be curved, planar, or have a combination of planar and non-planar surfaces.

A lining may be formed of the same or different material than the sleeve. For example, in embodiments having an integrally formed sleeve and lining, the sleeve and lining may be formed of the same material, and in embodiments having a separately formed sleeve and lining, the sleeve and lining may be formed of the same or different material. The lining and/or the sleeve may be formed of a wear resistant material such as at least one of a boride, nitride, carbide, such as tungsten carbide, silicon carbide, tantalum carbide, or titanium carbide, and polycrystalline diamond, or combinations thereof. Additionally, various binding metals may be included in the wear resistant material, such as cobalt, nickel, iron, metal alloys, or mixtures thereof. In a carbide wear resistant material, metal carbide grains are supported within a metallic binder, such as cobalt. An example carbide wear resistant material may include tungsten carbide particles dispersed in a cobalt binder, such as cemented tungsten carbide and cobalt (WC/Co). Such wear resistant materials include a hard particle phase and a metal binder phase, wherein the tungsten carbide particles form the hard particle phase and the cobalt forms the binder phase. Tungsten carbide may have, for example, a grain size ranging from about 6 microns or less (fine grain) in some embodiments, or greater than 6 microns (coarse grain) in other embodiments, and a binder content ranging from a lower limit selected from 6%, 8% and 10% by weight to an upper limit selected from 10%, 12%, 14% and 16% by weight.

Further, an inner cutter may have a diamond or other ultrahard material table bonded to a substrate, wherein the ultrahard material table forms the cutting face of the inner cutter, and wherein the substrate forms the body of the inner cutter. For example, as shown in FIG. 2, the inner cutter 230 has a cutting face 234 formed by a diamond table 235, which is bonded to a body 236. A diamond table may include polycrystalline diamond and/or thermally stable polycrystalline diamond. In some embodiments, the cutting face of the inner cutter may be formed of other ultrahard materials, such as cubic boron nitride, or a combination of diamond and at least one of a carbide, nitride, or boride material. For example, an inner cutter may have a diamond table bonded to a tungsten carbide body.

According to embodiments of the present disclosure, an inner cutter may be axially retained within a sleeve using a retention mechanism disposed between the sleeve and the body of the inner cutter. Retention mechanisms used to axially retain the inner cutter within the sleeve may allow the inner cutter to rotate as it contacts the formation to be drilled, while at the same time retaining the inner cutter within the sleeve and on the cutting tool. According to other embodiments, a retention mechanism may retain the inner cutter within the sleeve, but limit or prevent rotation of the inner cutter within the sleeve.

Referring again to FIG. 2, a retention mechanism 240 is disposed between the sleeve 210 and the body 236 of the inner cutter 230. The retention mechanism 240 shown is a pin that protrudes from a hole formed in the sleeve 210 and extends into a groove 237 formed in the inner cutter 230. However, in other embodiments, the retention mechanism may protrude from a hole formed in the body of the inner cutter and extends into a groove formed in an inner surface of the sleeve. As used herein, a hole may refer to a blind hole (a hole that does not extend completely through the thickness of the material) or a through hole (a hole that extends completely through the thickness of the material). In some embodiments, a retention mechanism may include at least one spring, at least one pin, and/or at least one ball. For example, in some embodiments having a retention mechanism disposed between at least one blind hole and/or groove, the retention mechanism may include a spring, such that the retention mechanism may be compressed when the inner cutter is being fitted into the sleeve and may expand into the corresponding blind holes and/or grooves to retain the inner cutter in a certain axial position within the sleeve. In some embodiments, a retention mechanism may include at least one ball disposed between corresponding grooves formed in an inner surface of the sleeve and a side surface of the inner cutter. Other examples of retention mechanisms that may be used to axially retain the inner cutter within the sleeve may be found in U.S. Patent Publication No. 2012/0273281, U.S. Patent Publication No. 2010/0314176, and U.S. Pat. No. 7,703,559, all of which are assigned to the present assignee or applicant and herein incorporated by reference in their entireties.

According to some embodiments of the present disclosure, a retention mechanism may include at least one corresponding groove and protrusion formed in an inner surface of the sleeve and a side surface of the inner cutter. In such embodiments, the sleeve may be formed by joining two or more pieces together around the inner cutter. For example, an inner cutter may have a groove and/or a protrusion formed around its circumference. A sleeve (which may or may not have a lining formed thereto) having a mating protrusion and/or groove formed around the inner surface of the sleeve may be split along the length of the sleeve into at least two pieces. The at least two pieces may be assembled around the inner cutter such that the mating groove(s) and protrusion(s) are aligned, and the at least two pieces may be bonded together.

Figure 8:
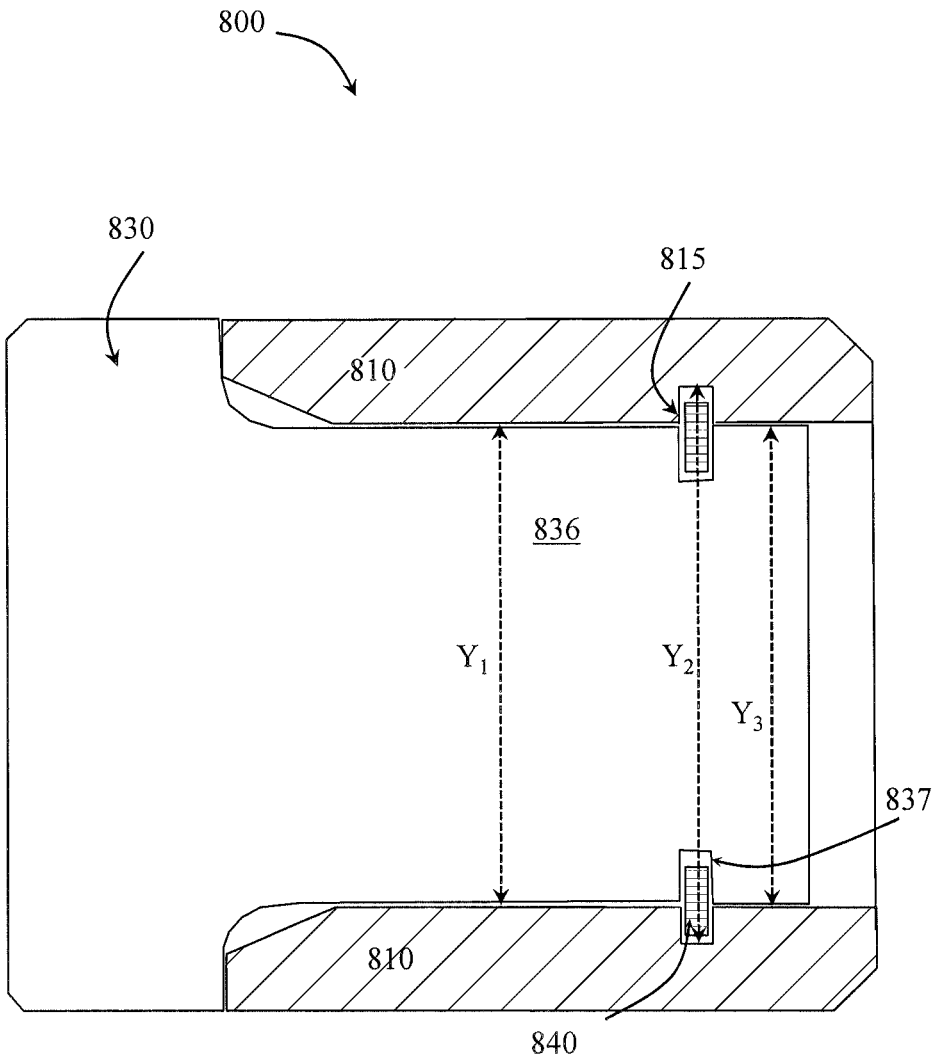
FIG. 8 shows a cross-sectional view of a cutting element assembly according to embodiments of the present disclosure.

In some embodiments, a retention mechanism may include a retaining ring. In such embodiments, the retaining ring may be disposed between the inner cutter and a sleeve, in a circumferential groove formed around the body of the inner cutter, wherein the retaining ring protrudes from the circumferential groove to a diameter greater than an inner diameter of the sleeve to retain the inner cutter axially in the sleeve. For example, FIG. 8 shows a cutting element assembly 800 according to embodiments of the present disclosure, wherein the retention mechanism used to retain an inner cutter 830 in a sleeve 810 includes a retaining ring 840. As shown, the inner cutter 830 is partially disposed within the sleeve 810, wherein the sleeve has a first inner diameter Y1, a second inner diameter Y2 and a third inner diameter Y3. Further, the second inner diameter Y2 is greater than both the first inner diameter Y1 and the third inner diameter Y3. The second inner diameter Y2 may be positioned axially along the sleeve 810 to form a corresponding channel 815 with a circumferential groove 837 formed in the inner cutter 830. The retaining ring 840 may be disposed within the channel 815 and the circumferential groove 837 to retain the inner cutter 830 within the sleeve 810. The retaining ring 840 extends at least around the entire circumference of the body 836 of the inner cutter 830, for example, the retaining ring 840 may extend greater than 1.5 times around the circumference of the body 836. The groove 837 may have any profile that is able to retain the retaining ring, such as semi-round circle or irregular geometries.

Further, the third inner diameter Y3 is shown as having the same size as the first inner diameter Y1. However, according to some embodiments, the second inner diameter may be greater than both the first and third inner diameters, and the third inner diameter may be greater than or less than the first inner diameter. According to other embodiments, a sleeve may have a second inner diameter (larger than the first inner diameter) extend from the first inner diameter to a third inner diameter, wherein the third inner diameter is larger than the second inner diameter. In yet other embodiments, a sleeve may have two inner diameters, a first inner diameter smaller than a second inner diameter. In such embodiments, a retaining ring may protrude from a circumferential groove formed around the body of an inner cutter to a diameter greater than the first inner diameter.

Figure 9:
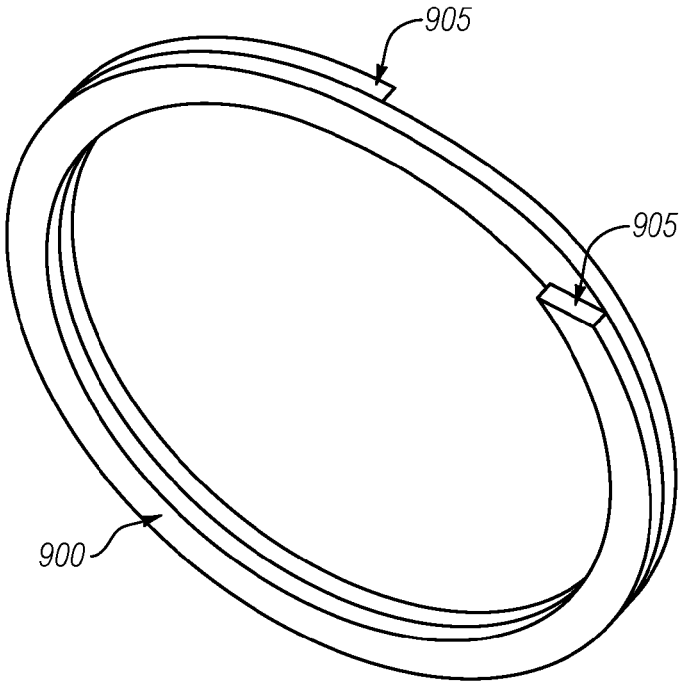
FIGS. 9 and 10 show perspective views of retaining rings according to embodiments of the present disclosure.
Figure 10:
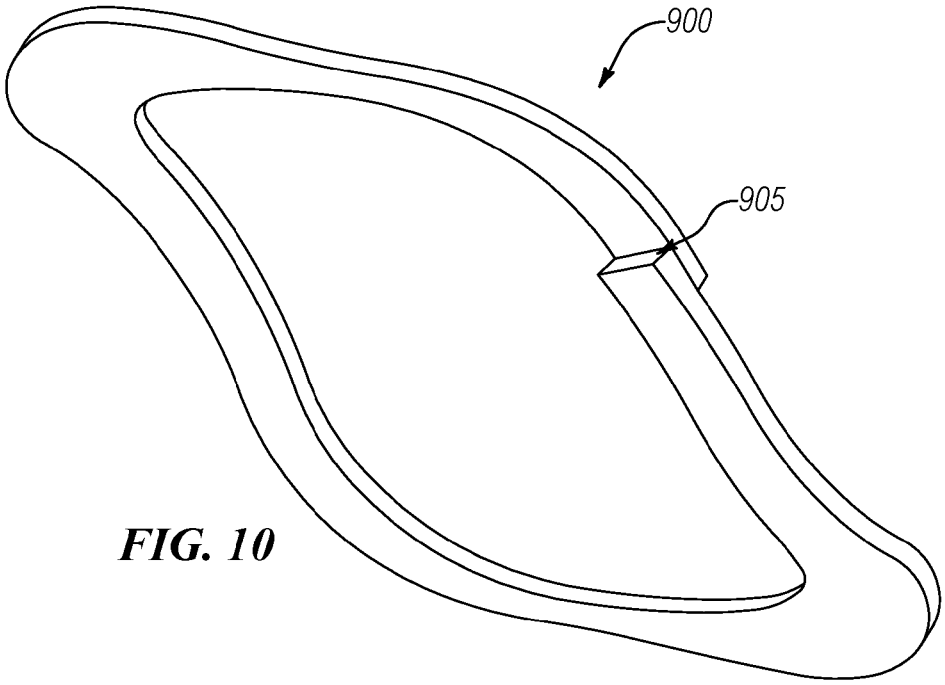

A retaining ring may be planar or non-planar, or a combination of one or more planar rings may be used with one or more non-planar rings. For example, FIG. 9 show a planar closed loop retaining ring 900 according to embodiments of the present disclosure having unattached ends 905 so that the retaining ring may be radially compressed or tightened. FIG. 10 shows a non-planar closed loop retaining ring 1000 having overlapping ends 1005. The non-planar retaining ring 1000 may have an undulating shape, which may act as a spring when axial force is applied to the inner cutter, such as during drilling operations. Further, according to some embodiments of the present disclosure, two or more retaining rings may be attached or stacked together to form a spring, wherein at least one retaining ring is non-planar and at least one retaining ring is planar. For example, a non-planar retaining ring may be disposed between two planar retaining rings and welded together at crests formed by the undulating shape of the non-planar retaining ring, a planar retaining ring may be disposed between two non-planar retaining rings, two or more non-planar retaining rings may be attached, or two or more non-planar and two or more planar retaining rings may be attached. Further, in combinations using two or more non-planar retaining rings, the non-planar retaining rings may be attached at unsynchronized undulations to form a spring.

Figure 11:
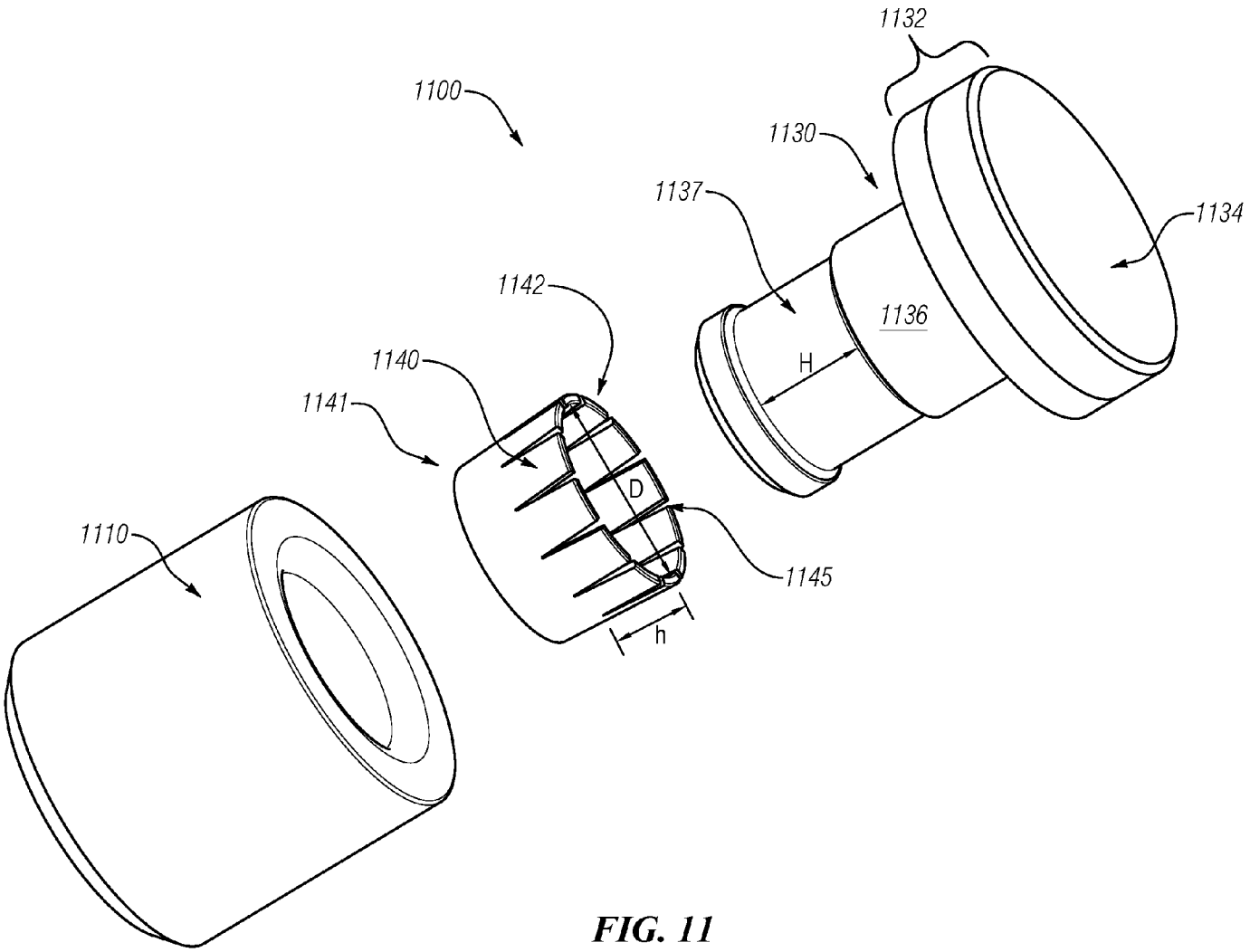
FIG. 11 shows an exploded view of a cutting element assembly according to embodiments of the present disclosure.

FIG. 11 shows another example of a retaining ring that may be used to retain an inner cutter within a sleeve (or sleeve portion of an integral sleeve and lining support structure). As shown, a cutting element assembly 1100 includes an inner cutter 1130, a retaining ring 1140, and a sleeve 1110. The inner cutter 1130 has a cutting face 1134 and a body 1136 extending therefrom. The inner cutter 1130 has a cutting end 1132 that extends a depth from a cutting face 1134, a body 1136 and a side surface 1138. The cutting face 1134 may be formed from a diamond or other ultrahard material table. A circumferential groove 1137 is formed around the outer surface of the body 1136, wherein the circumferential groove 1137 extends an axial height H along the body 1136. The retaining ring 1140 is a closed loop ring and has slits 1145 spaced around the retaining ring 1140, extending axially through a partial height h of the retaining ring 1140. For example, the slits 1145 may be equally or unequally spaced around the retaining ring 1140. Further, the retaining ring 1140 has a diameter D that changes along its height. For example, the diameter D may gradually increase along the partial height h of the slits 1145, from a bottom end 1141 to a top end 1142.

Figure 12:
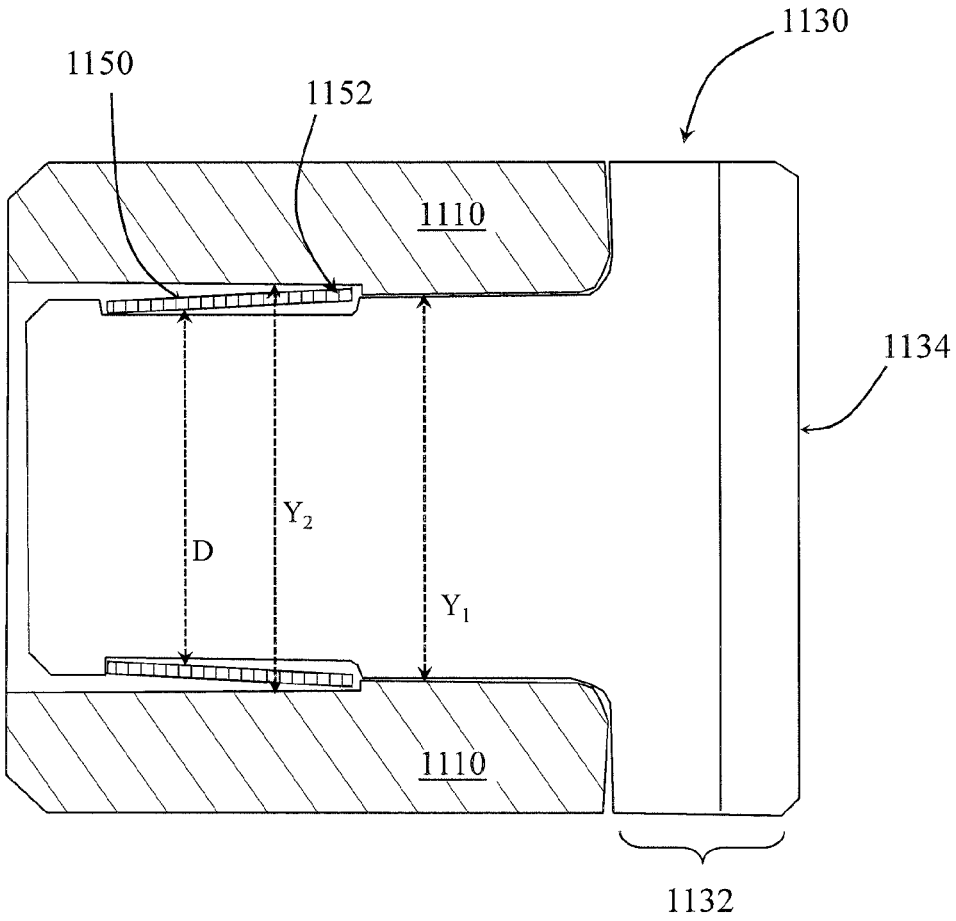
FIG. 12 shows a cross-sectional view of a cutting element assembly according to embodiments of the present disclosure.

The retaining ring 1140 may be positioned within the circumferential groove 1137 such that the slits 1145 extend radially outward from the outer surface of the inner cutter 1130 and axially towards the cutting face 1134. FIG. 12 shows a cross-sectional view of the components shown in FIG. 11, as assembled. As shown, the inner cutter 1130 is disposed within the sleeve 1110, and the retaining ring 1140 is disposed within the circumferential groove 1137 between the inner cutter 1130 and the sleeve 1110. The sleeve 1110 has a first inner diameter Y1 and a second inner diameter Y2, wherein the second inner diameter Y2 is larger than the first inner diameter Y1. The retaining ring 1140 has a gradually increasing diameter D such that the top end 1142 of the retaining ring 1140 protrudes a distance from the circumferential groove 1137 to contact the larger second inner diameter Y2 of the sleeve 1110, thereby retaining the rolling cutter 1130 within the sleeve 1110.

The slits 1145 formed in the retaining ring 1140 may provide the retaining ring 1140 with spring action. Particularly, by providing slits 1145 axially (or substantially axially, such as extending spirally along an angle less than about 45 degrees from a line parallel with the longitudinal axis of the retaining ring) along a partial height h of the retaining ring 1140, the retaining ring 1140 may act as a spring, which may be radially compressed and spring radially outward along the partial height h of the slits 1145. Advantageously, by extending radially outward to contact the larger inner diameter Y2 of the sleeve 1110, the retaining ring 1140 may axially maintain the inner cutter 1130 tight against the sleeve 1110, which may reduce or prevent debris from entering between the inner cutter 1130 and the sleeve 1110, while also radially maintaining the inner cutter 1130 within the center of the sleeve 1110. A lining (not shown) may further be attached to the sleeve 1110, as described herein, such that an interfacing surface of the lining interfaces with the side surface 1138 of the cutting end 1132 of the inner cutter 1130.

Figure 4:
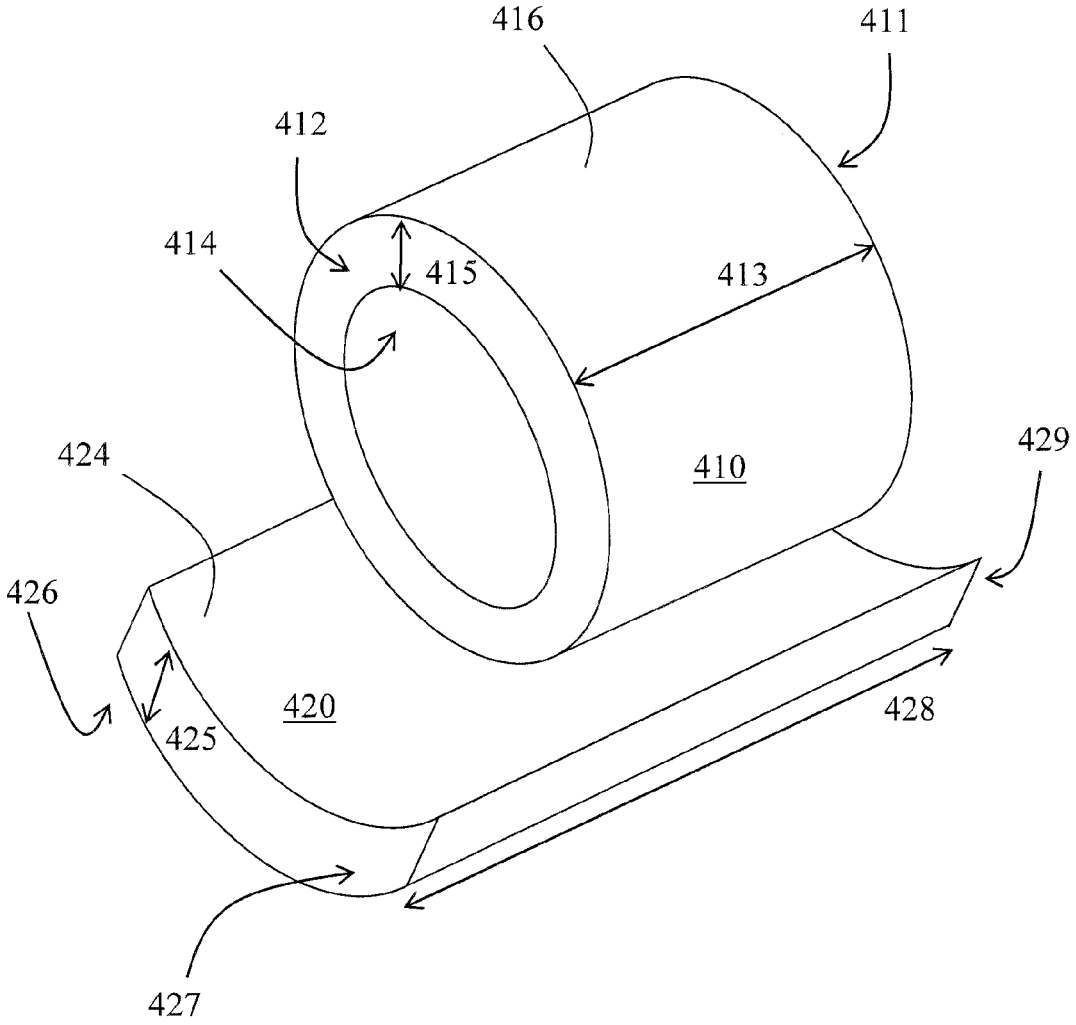
FIG. 4 is an exploded view of a sleeve and lining assembly according to embodiments of the present disclosure.
Figure 5:
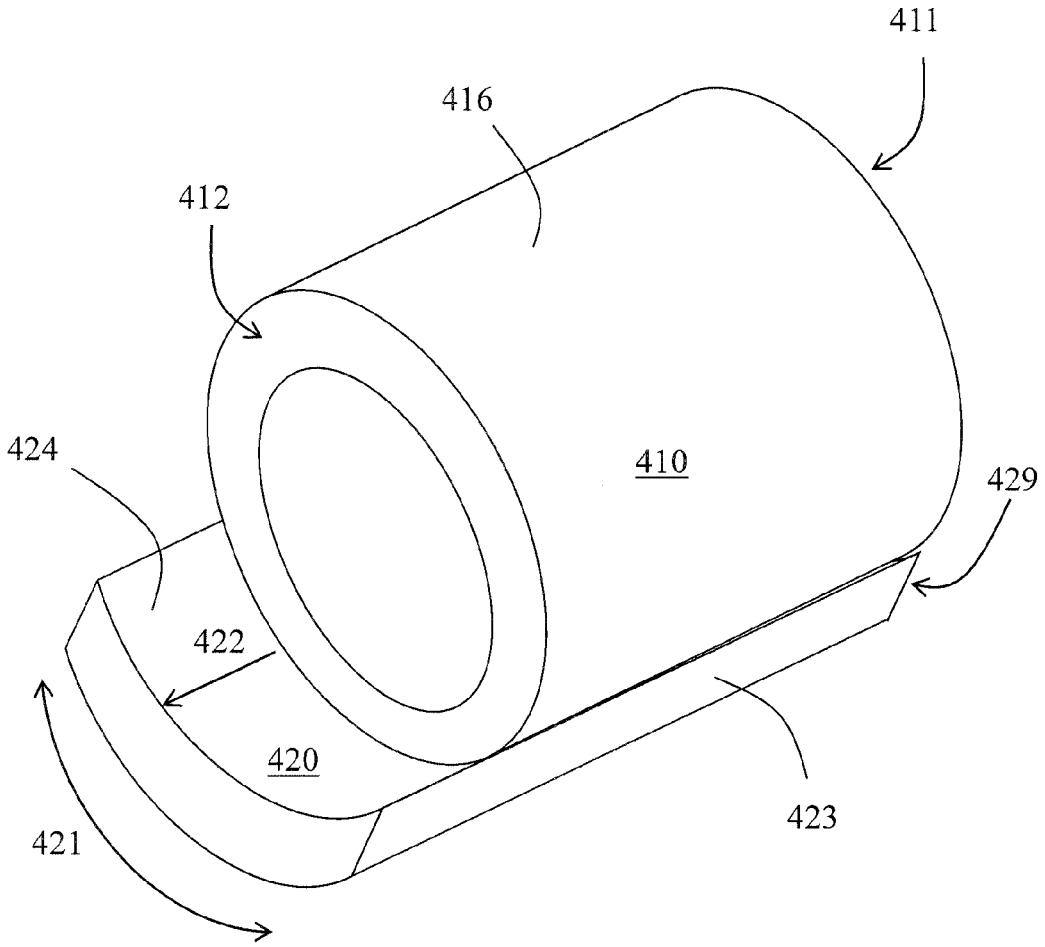
FIG. 5 is a perspective view of a sleeve and lining assembly according to embodiments of the present disclosure.

Referring now to FIGS. 4 and 5, an exploded and perspective view of a sleeve 410 and lining 420 assembly are shown. The sleeve 410 has an inner surface 414, an outer surface 416 and a sleeve thickness 415 measured between the inner surface 414 and outer surface 416. Further, the sleeve 410 has a length 413 measured between a first end 412 and a second end 411. The lining 420 has an interfacing surface 424, a base surface 426, and a lining thickness 425 measured between the interfacing surface 424 and the base surface 426. Further, the lining 420 has a length 428 measured between a first end 427 and a second end 429. The interfacing surface 424 of the lining 420 is assembled (shown in FIG. 5) to interface a portion of the outer surface 416 of the sleeve 410 such that the lining 420 extends an arc length 421 around the outer surface 416 of the sleeve 410 and a distance 422 axially from the first end 412 of the sleeve 410. Upon assembly, the lining 420 may have at least one side surface 423 that transitions to the outer surface 416 of the sleeve 410, i.e., the at least one side surface 423 extends tangentially from the line of contact between the side surface 423 and the sleeve outer surface 416. Further, the sleeve second end 411 and the lining second end 429 may be aligned or non-aligned. For example, the lining second end 429 may be axially aligned between the sleeve first end 412 and sleeve second end 411, or the lining second end 429 may extend axially from the sleeve second end 411, distal from the sleeve first end 412. The lining 420 may be attached to the sleeve 410 by brazing or other means known in the art.

According to embodiments of the present disclosure, a sleeve and a lining may be integrally formed together to form a support structure with a non-uniform wall thickness. For example, FIG. 6 shows an embodiment of a support structure 600 with a non-uniform wall thickness that has a sleeve portion 610 and a lining portion 620 extending a distance axially from the sleeve portion 610, wherein the sleeve portion and lining portion are integrally formed together. An inner cutter (not shown) may be partially disposed within the support structure 600, such as described above, for example, wherein the body of the inner cutter is at least partially disposed within the sleeve portion and wherein the cutting end of the inner cutter interfaces with an interfacing surface of the lining portion.

According to embodiments of the present disclosure, the wall thickness of a support structure is measured between an inner surface and an outer surface. The wall thickness may vary between the sleeve portion and the lining portion, and/or the wall thickness may vary within each portion. For example, the wall thickness of the sleeve portion (i.e., the sleeve thickness) and/or the wall thickness of the lining portion (i.e., the lining thickness) may have different thicknesses.

As shown in FIG. 6, the lining portion 620 of the support structure 600 has an inner surface (referred to as an interfacing surface 624 when describing the lining portion), an outer surface (referred to as a base surface 626 when describing the lining portion), and at least one side surface 623, wherein a lining thickness 625 is measured between the interfacing surface 624 and the base surface 626. The base surface 626 may have at least one non-planar surface and/or at least one planar surface that do not correspond with the interfacing surface, such that the lining thickness 625 varies across the arc length 621. However, according to other embodiments, the lining thickness may be constant across the arc length of the lining portion. Further, the interfacing surface 624 may be non-planar and correspond with the outer side surface of an inner cutter (not shown), while the base surface 626 may be planar, non-planar, or a combination of planar and non-planar surfaces. For example, as shown, the base surface 626 may have a non-planar portion that corresponds with the interfacing surface 624 and two planar portions adjacent the two side surfaces 623 of the lining portion 620.

Further, the sleeve portion 610 of the support structure 600 has a sleeve thickness 615 measured between an inner surface 614 and an outer surface 616. The inner surface 614 of the sleeve portion 610 may have a substantially cylindrical shape to correspond with an inner cutter (not shown) to be inserted therein. The outer surface 616 of the sleeve portion 610 may have at least one non-planar surface and/or at least one planar surface that do not correspond with the inner surface 614, such that the sleeve thickness 615 varies around the circumference of the sleeve portion 610. As shown, a portion of the outer surface 616 substantially corresponds with the shape of the inner surface 614, while another portion of the outer surface 616 includes planar and non-planar surfaces that do not correspond with the shape of the inner surface. Further, a portion of the outer surface 616 smoothly transitions into the base surface 626 of the lining portion 620. However, according to other embodiments, the transition from the outer surface of the sleeve portion to the base surface of the lining portion may be abrupt or include non-planar surfaces. An inner cutter (not shown) may be inserted into the sleeve 610 and lining 620 assembly such that a portion of the inner cutter body is retained within the sleeve portion 610, and the cutting end of the inner cutter interfaces with the interfacing surface 624 of the lining portion 620.

Figure 13:
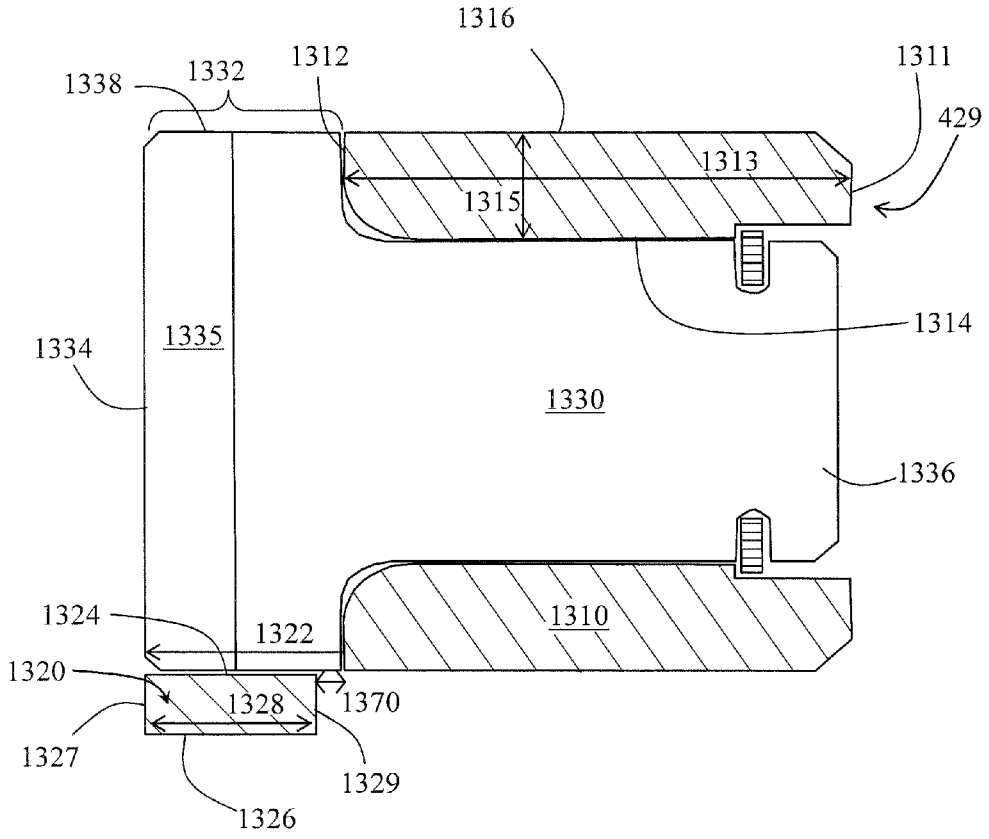
FIG. 13 shows a cross-sectional view of a cutting element assembly according to embodiments of the present disclosure.
Figure 14:
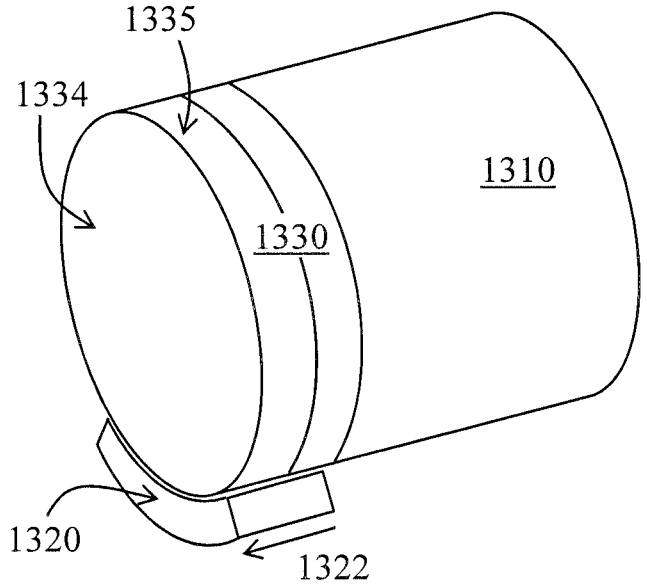
FIG. 14 shows a perspective view of a cutting element assembly according to embodiments of the present disclosure.
Figure 15:
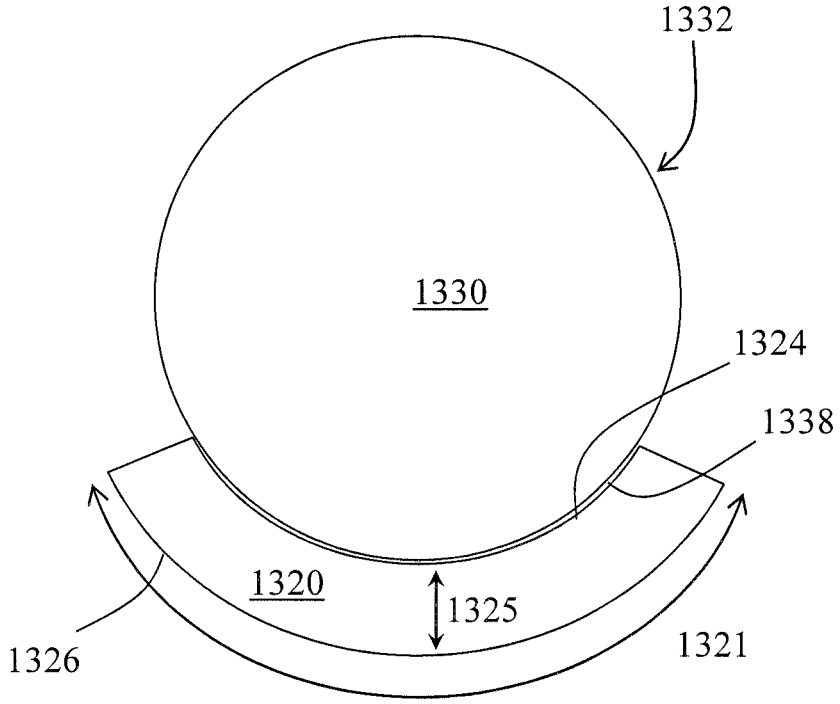
FIG. 15 shows a front view of a cutting element assembly according to embodiments of the present disclosure.

According to embodiments of the present disclosure, a lining formed as a piece separate from a sleeve may overlap the sleeve or may not overlap the sleeve. For example, referring now to FIGS. 13-15, a cross-sectional view and perspective views of a sleeve 1310 and lining 1320 assembly around an inner cutter 1330 are shown. The sleeve 1310 has an inner surface 1314, an outer surface 1316 and a sleeve thickness 1315 measured between the inner surface 1314 and outer surface 1316. Further, the sleeve 1310 has a length 1313 measured between a first end 1312 and a second end 1311. The lining 1320 has a length 1328 measured between a first end 1327 and a second end 1329. Further, the lining 1320 has an interfacing surface 1324, a base surface 1326, and a lining thickness 1325 (shown in FIG. 15) measured between the interfacing surface 1324 and the base surface 1326. The interfacing surface 1324 of the lining 1320 is assembled to interface a portion of the inner cutter 1330 such that the lining 1320 extends an arc length 1321 around the inner cutter 1330 (shown in FIG. 15). As shown, the inner cutter 1330 has a side surface 1338, a cutting face 1334 and a body 1336 extending from the cutting face 1334, wherein the cutting face 1334 may be formed from a diamond or other ultrahard material table 1335. The inner cutter 1330 also has a cutting end 1332 that extends a depth from the cutting face 1334. Upon assembly, the interfacing surface 1324 of the lining 1320 may interface the side surface 1338 of the cutting end 1332 of the inner cutter 1330.

The lining 1320 extends a distance 1322 axially from the sleeve first end 1312 wherein the lining second end 1329 may be aligned or non-aligned with the sleeve first end 1312. For example, the lining second end 1329 may be axially aligned with the sleeve first end 1312, or, as shown, the lining second end 1329 may extend axially from a distance apart from the sleeve first end 1312 such that the lining 1320 and the sleeve 1310 are not overlapping. In other words, the second end 1329 of the lining 1320 may be positioned at a point located an axial distance 1370 away from the first end 1312 of the sleeve 1310, wherein the lining 1320 extends from the point in a direction away from the first end 1312 of the sleeve 1310. According to embodiments of the present disclosure, an axial distance 1370 between the second end 1329 of a lining 1320 and a first end 1312 of a sleeve 1310 may range from greater than 0 to 0.1 inches. In some embodiments, the axial distance 1370 between the lining and sleeve may range from greater than 0 to 0.08 inches. In some embodiments, the axial distance 1370 may be at least 0.02 inches. Further, other distances may be selected based on the relative location of the diamond table/substrate interface. Specifically, in one or more embodiments, the axial distance may be selected so that the second end 1329 of the lining 1320 falls on either side of (but not in line with) the diamond/substrate interface. The lining 1320 may be attached within an inset formed in a cutter pocket (not shown) by brazing or other means known in the art.

Figure 16:
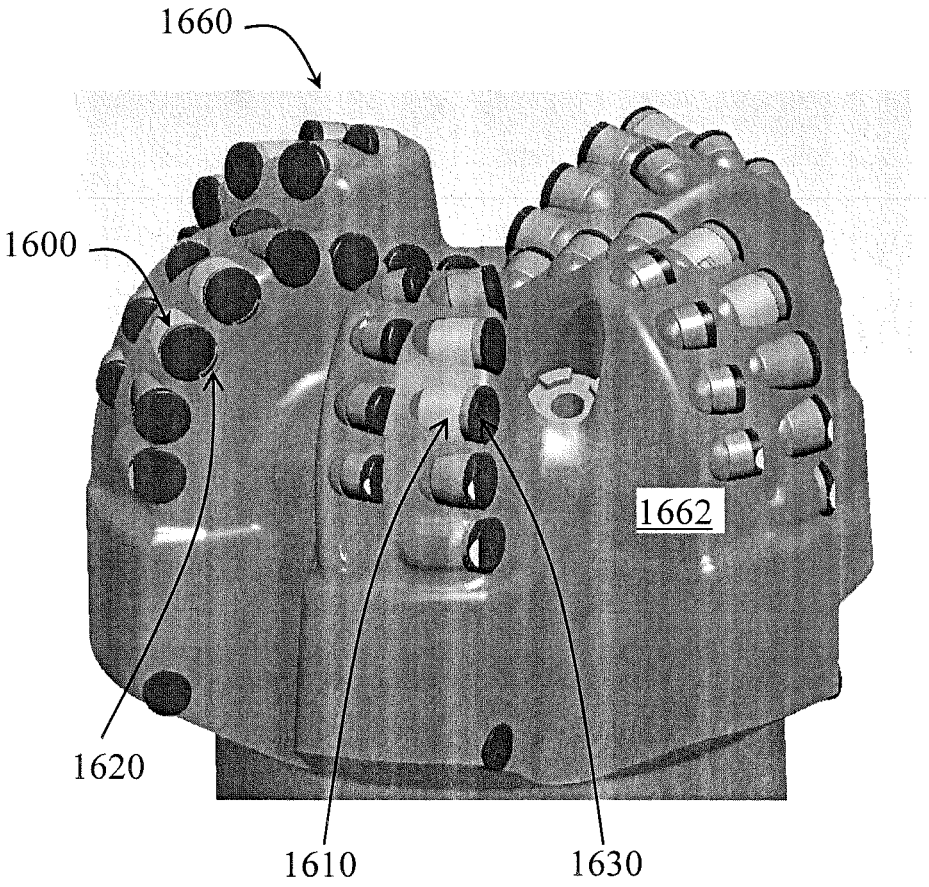
FIG. 16 shows cutting element assemblies of the present disclosure disposed on a drill bit.

For example, FIG. 16 shows cutting element assemblies according to embodiments disposed in cutter pockets formed in a drilling tool. As shown, the cutting element assemblies 1600 include a sleeve 1610, a lining 1620 and an inner cutter 1630 partially disposed within the sleeve 1610. The cutting element assemblies 1600 along with other types of cutting elements are disposed in cutter pockets formed in the blades 1662 of a drill bit 1660. However, in other embodiments, cutting element assemblies of the present disclosure may be disposed in cutter pockets formed in other drilling tools, such as reamers or other types of drill bits, for example. The sleeve 1610 and lining 1620 of each cutting element assembly 1600 may be brazed or otherwise attached to the cutter pocket.

Figure 17:
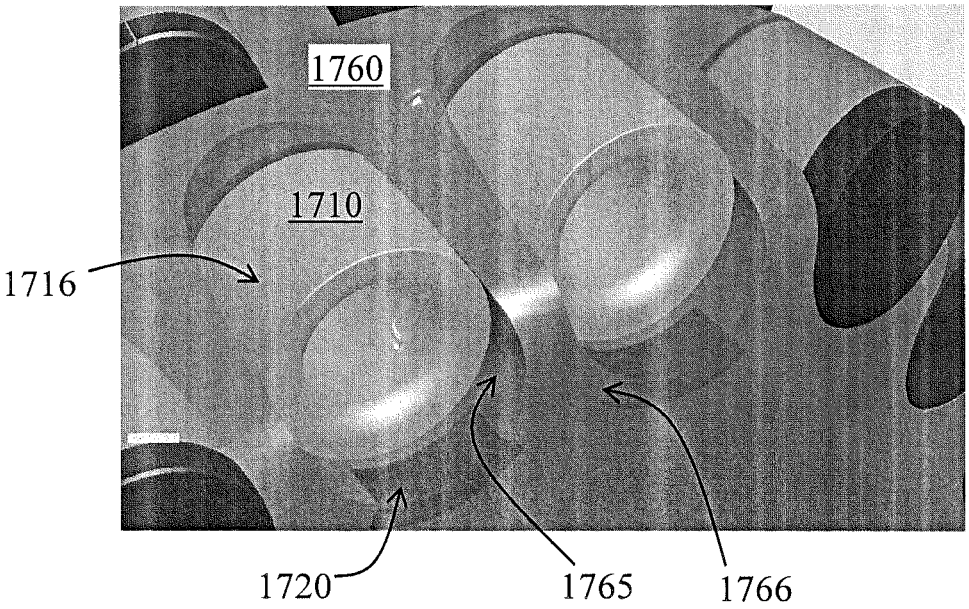
FIG. 17 shows a perspective view of a sleeve and lining assembly of the present disclosure disposed in a cutter pocket of a drilling tool.
Figure 18:
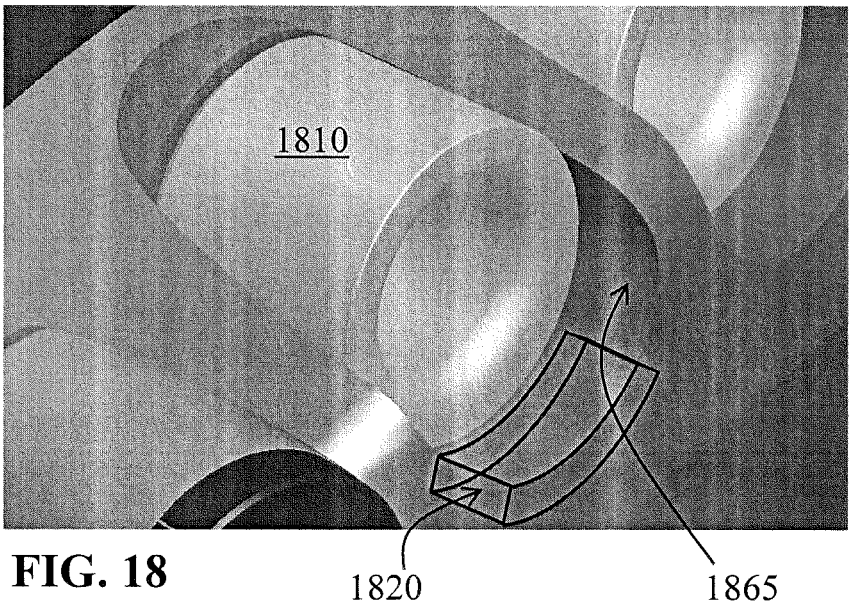
FIG. 18 shows a perspective view of a sleeve and lining assembly of the present disclosure disposed in a cutter pocket of a drilling tool.

Referring now to FIGS. 17 and 18, sleeve and lining assemblies disposed in a cutter pocket are shown. Particularly, FIG. 17 shows a sleeve 1710 and a lining 1720 attached within a cutter pocket 1765 formed within a drilling tool 1760. As shown, the sleeve 1710 may be assembled and attached within the cutter pocket 1765 lengthwise, such that the sleeve 1710 lays along its outer surface 1716 against the side wall of the cutter pocket 1765. The lining 1720 is disposed in an inset 1766 formed within the side wall of the cutter pocket 1765. The lining 1720 may be casted, infiltrated, brazed or otherwise attached to the cutter pocket 1765. In some embodiments, such as shown in FIG. 18, a sleeve 1810 may be brazed or otherwise attached to a cutter pocket 1865, while a lining 1820 may be formed as part of the cutter pocket 1865.

Figure 19:
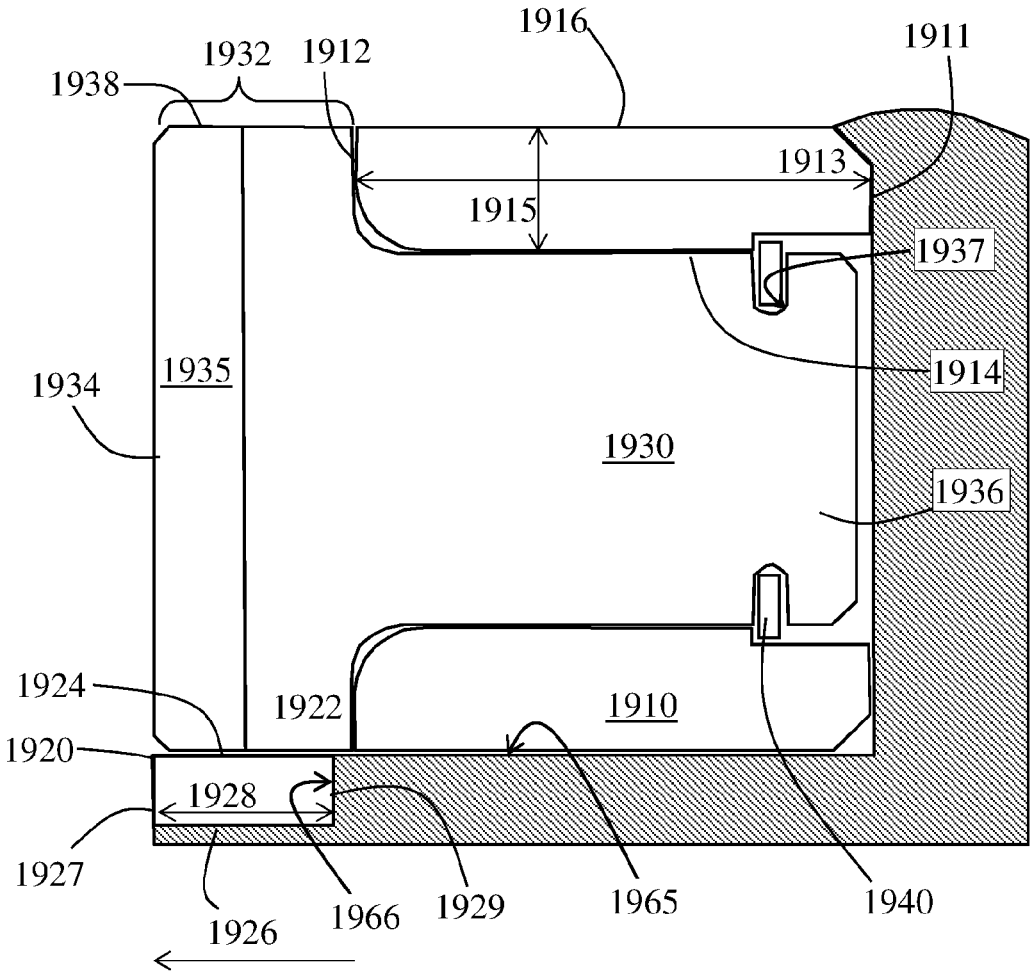
FIG. 19 shows a cross-sectional view of a cutting assembly of the present disclosure disposed in a cutter pocket.

FIG. 19 shows a cross-sectional view of a cutting element assembly 1900 according to embodiments of the present disclosure disposed within a cutter pocket 1965. The cutting element assembly 1900 includes a sleeve 1910, a lining 1920, and an inner cutter 1930 disposed within the sleeve 1910. The sleeve 1910 has a sleeve thickness measured between an inner surface 1914 and an outer surface 1916 and a length 1913 measured between a first end 1912 and a second end 1911. The inner cutter 1930 has a side surface 1938, a cutting face 1934 and a body 1936 extending from the cutting face 1934, wherein the cutting face 1934 may be formed from a diamond or other ultrahard material table. The inner cutter 1930 also has a cutting end 1932 that extends a depth from the cutting face 1934, wherein the diameter of the cutting end 1932 is larger than a diameter of the portion of the body 1936 disposed within the sleeve 1910. The diameter of the cutting end 1932 may be substantially equal to the diameter of the sleeve outer surface 1916. However, in some embodiments, the diameter of an inner cutter cutting end may be larger or smaller than the diameter of the sleeve outer surface. Further, a retaining ring may be disposed between the inner cutter 1930 and the sleeve 1910 within a circumferential groove 1937 formed the side surface 1938 of the inner cutter 1930 and/or the inner surface 1914 of the sleeve 1910 to retain the inner cutter 1930 within the sleeve 1910.

The lining 1920 has a length measured between a first end 1927 and a second end 1929 and a thickness measured between an interfacing surface 1924 and a base surface 1926. The lining 1920 may be attached within an inset 1966 formed in the side wall of the cutter pocket 1965. Upon assembly of the sleeve 1910, the lining 1920 and the inner cutter 1930 within the cutter pocket 1965, the interfacing surface 1924 of the lining 1920 may interface the side surface 1938 of the cutting end 1932 of the inner cutter 1930.

The lining 1920 extends a distance 1922 axially from the sleeve first end 1912 wherein the lining second end 1929 may be aligned or non-aligned with the sleeve first end 1912. The interfacing surface 1924 of the lining 1920 is assembled to interface a portion of the inner cutter 1930 such that the lining 1920 extends an arc length around the side surface 1938 of the inner cutter 1930.

Figure 20:
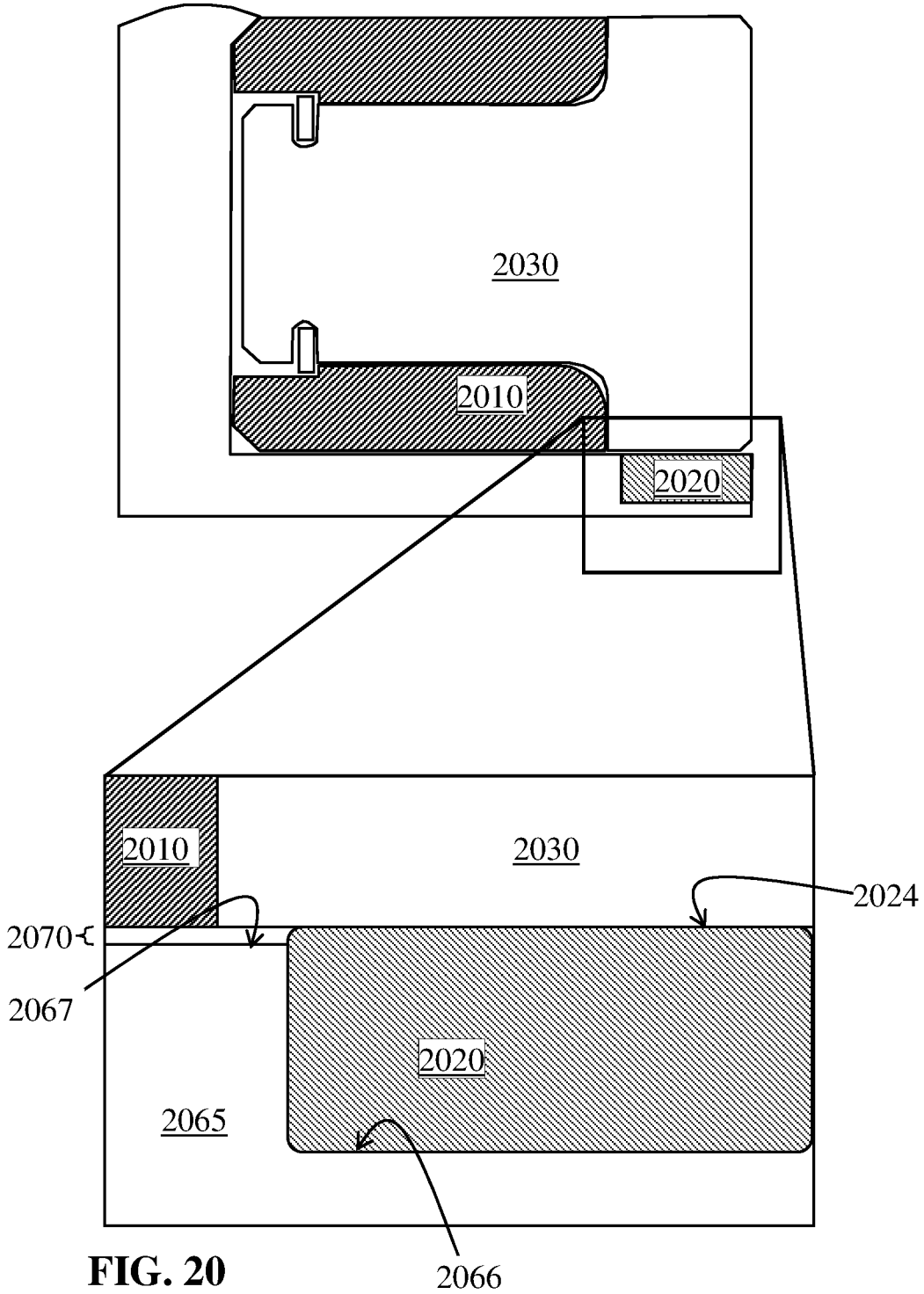
FIG. 20 shows a partial cross-sectional view of a cutting assembly of the present disclosure disposed in a cutter pocket.
Figure 21:
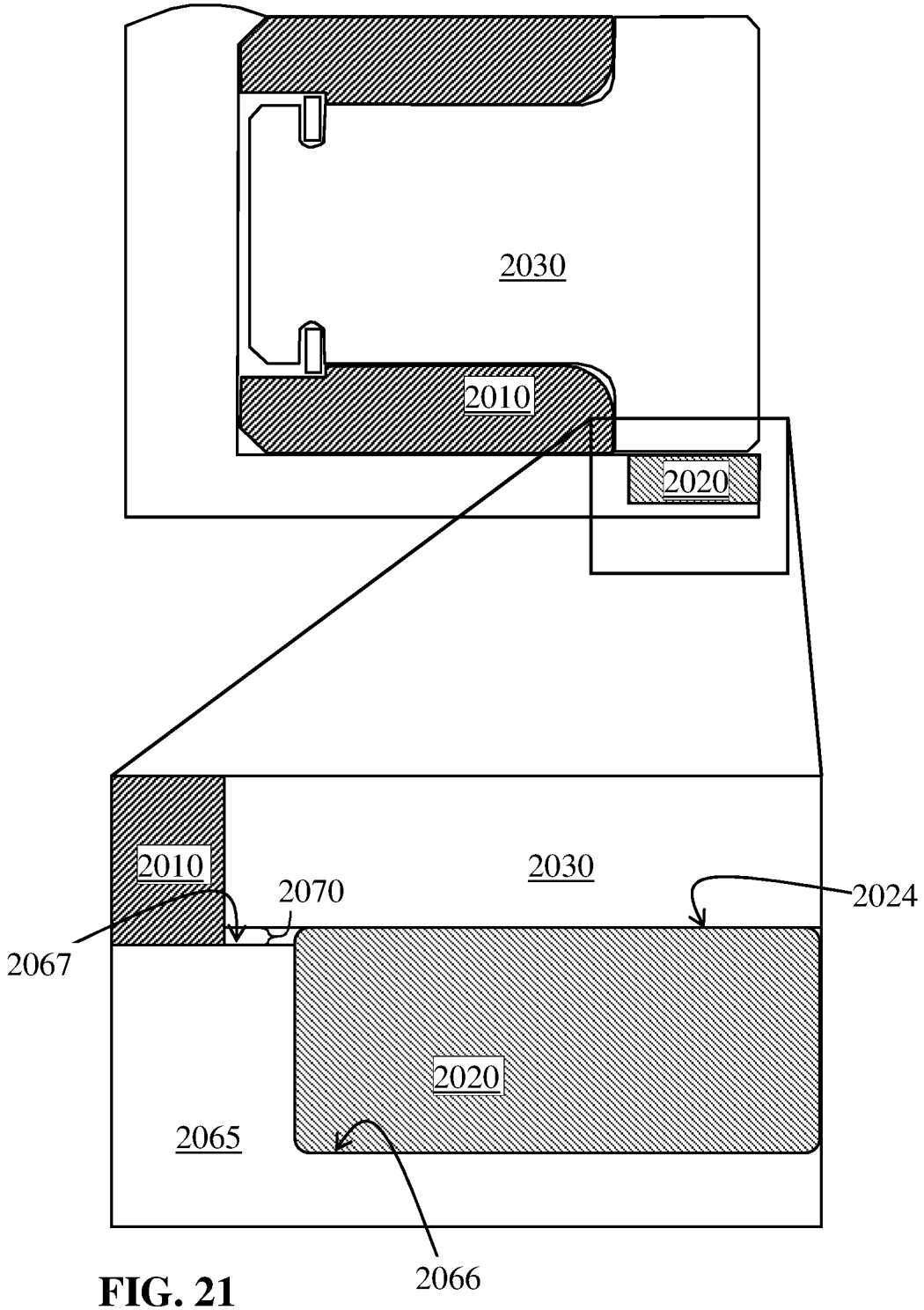
FIG. 21 shows a partial cross-sectional view of a cutting assembly of the present disclosure disposed in a cutter pocket.

Further, the lining 1920 may be aligned or non-aligned radially with the sleeve 1910. For example, FIGS. 20 and 21 show an expanded section of a partial cross-sectional view of cutting element assemblies according to embodiments of the present disclosure disposed in a cutter pocket. As shown in FIG. 20, a sleeve 2010 and an inner cutter 2030 is disposed in a cutter pocket 2065 formed in a drilling tool, and a lining 2020 is disposed in an inset 2066 formed in the cutter pocket 2065 side wall. The lining 2020 extends a distance 2070 above the cutter pocket 2065 side wall, and the sleeve 2010 is disposed the distance 2070 away from the cutter pocket 2065 side wall, such that the outer surface of the sleeve 2010 is substantially aligned with the interface surface of the lining 2020. However, as shown in FIG. 21, the lining 2020 extends a distance 2070 above the cutter pocket 2065 side wall, and the sleeve 2010 is disposed a smaller distance away from the cutter pocket 2065 side wall (or adjacent the cutter pocket side wall), such that the outer surface of the sleeve 2010 is not aligned with the interface surface of the lining 2020.

A lining may be offset from the cutter pocket side wall such that the interface surface of the lining (i.e., the surface of the lining that is positioned to interface with the inner cutter) extends a distance above the cutter pocket side wall. For example, as shown in FIGS. 20 and 21, the interface surface 2024 of the lining 2020 extends a distance 2070 above the side wall 2067 of the cutter pocket 2065, i.e., the interface surface 2024 extends more radially inward than the cutter pocket side wall 2067. The distance apart between the lining interface surface and the cutter pocket side wall may provide space for a brazing material to be disposed between the cutter pocket side wall and a sleeve holding an inner cutter. For example, the lining may be lifted (at a distance higher than the cutter pocket side wall) to interface with the cutting end of the inner cutter in order to compensate for the brazing material thickness (between the cutter pocket side wall and the sleeve) such that when a load is applied to the inner cutter (e.g., during drilling), the load may be transferred to the lining. According to some embodiments, the interface surface of a lining may be offset a distance less than about 0.008 inches from the cutter pocket side wall. In some embodiments, an offset distance between the lining interface surface and the cutter pocket side wall may range from about 0.003 inches to about 0.005 inches. In some embodiments, an offset distance between the lining interface surface and the cutter pocket side wall may be less than 0.003 inches.

According to one or more embodiments of the present disclosure, a lining may be a preformed piece. For example, as shown in FIGS. 2 and 4, a lining 220, 420 is a preformed piece that is disposed adjacent to a sleeve 210, 410. However, according to some embodiments of the present disclosure, a lining may be applied to a cutter pocket side wall as a hardfacing layer. For example, referring now to FIG. 22, a lining 2220 may be separate from a sleeve 2210 and formed on a cutter pocket side wall 2267. The lining 2220 may be formed of a hard abrasive resistance coating, such as one or more layers of hardfacing material. Such hardfacing materials may include any tungsten carbide based (including, for example, cemented or cast tungsten carbide based hardfacings) hardfacings or any other hardfacings used on steel body bits. In embodiments having a lining disposed on a cutter pocket side wall by applying one or more hardfacing layers to the cutter pocket side wall, the lining may have a thickness of less than about 0.008 inches. In some embodiments, a lining disposed on a cutter pocket side wall may have a thickness of less than about 0.005 inches.

Linings of the present disclosure may be used to support the cutting end of a cutting element. For example, as rolling cutters contact and rotate against a formation, a cutting load may be applied in an axial and radial direction against the cutting element, which may cause bending to occur in the shaft region of the cutting element. According to embodiments of the present disclosure, a lining may be used to support portions of the cutting element subjected to the cutting load, such as the cutting end of the cutting element, and thus, may inhibit cutting element failure due to bending.

Figure 22:
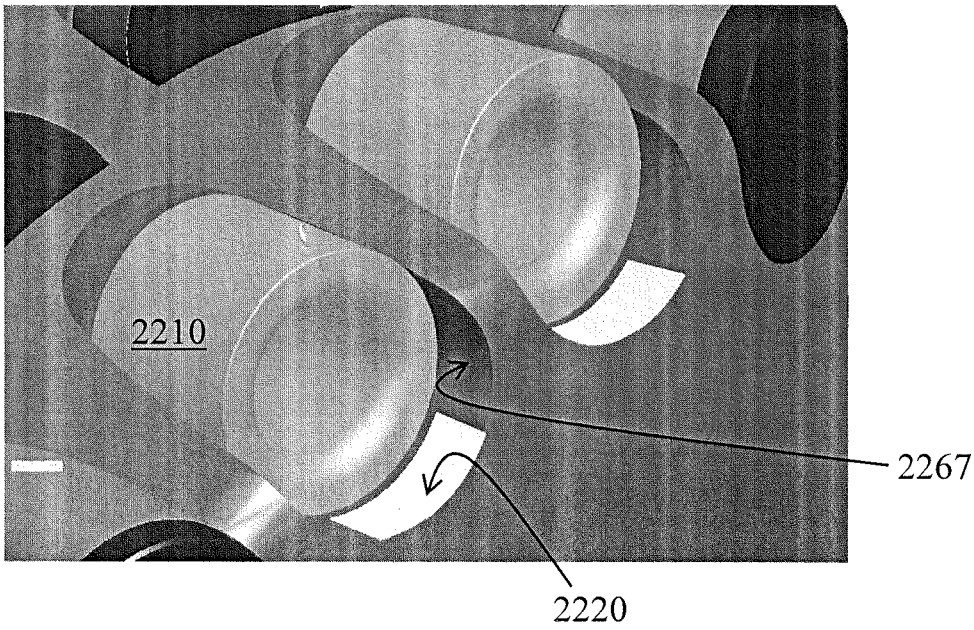
FIG. 22 shows a perspective view of a sleeve and lining assembly of the present disclosure disposed in a cutter pocket.

Further, a lining may or may not be disposed in an inset formed in a cutter pocket. For example, as shown in FIG. 17, a lining 1720 may be disposed in an inset 1766 formed within the side wall of a cutter pocket 1765. An inset may be sized and shaped to correspond with the size and shape of a lining or lining portion of a support structure, such as described above. However, as shown in FIG. 22, a lining 2220 may be disposed on a cutter pocket side wall 2267 without the use of an inset.

Figure 7:
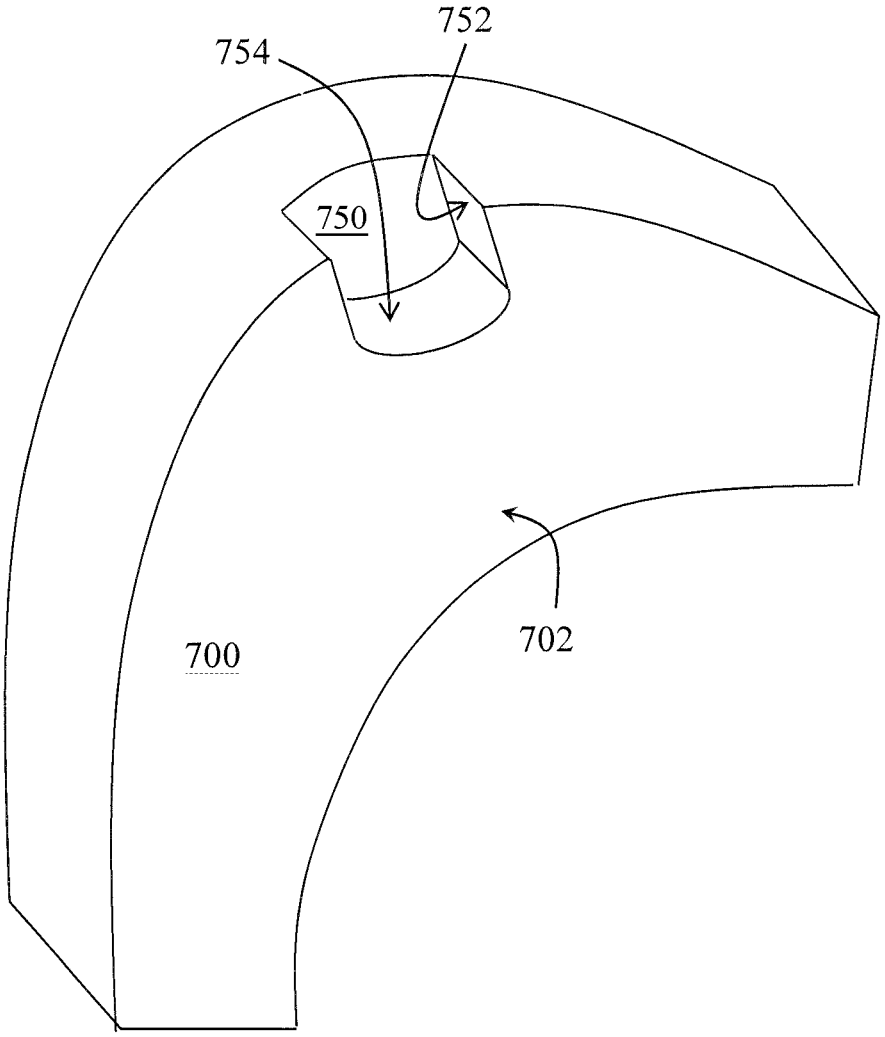
FIG. 7 shows a perspective view of a blade having a cutter pocket formed therein according to embodiments of the present disclosure.

Cutting elements of the present disclosure may be attached within cylindrical or non-cylindrical cutter pockets formed in cutting tools, such that the cutter pockets have negative space corresponding with the shape of the lining and sleeve assembled together (or the shape of the support structure in embodiments having the lining and sleeve integrally formed together). For example, where a conventionally formed cutter pocket used to receive a cylindrical cutting element would have a corresponding partial cylindrical cut-out formed in the cutting tool (i.e., have a semi-circular cross-section cut-out), cutter pockets of the present disclosure may have a cut-out corresponding to a portion of the sleeve and the lining, which may have a cross-sectional cut-out in the shape of a partial circle, a partial ellipse, a combination of curved and planar sides, a partial reuleaux polygon, or other non-circular shape. FIG. 7 shows an example of a cutter pocket 750 formed at the leading face 702 of a blade 700 of a cutting tool. The cutter pocket 750 has a combination of planar sides 752 and non-planar sides 754. In the embodiment shown in FIG. 7, the non-planar side 754 may correspond with a curved base surface of a lining, and the planar sides 752 may correspond with planar outer surfaces of the lining and sleeve.

Cutting elements of the present disclosure may be attached within cutter pockets formed in cutting tools, such as a drill bit, reamer, or other tool used to cut an earthen formation. For example, a drill bit may have a bit body with a plurality of blades extending radially therefrom. At least one cutting element according to embodiments of the present disclosure may be disposed in a cutter pocket formed on the plurality of blades. The at least one cutting element assembly may include a sleeve, a lining extending a distance axially from an end of the sleeve and an inner cutter, wherein the inner cutter has a cutting end extending a depth from a cutting face, a side surface, and a body. The body of the inner cutter is at least partially disposed within the sleeve, and the side surface of the cutting end interfaces with an interfacing surface of the lining. As described above, the lining may be integral with the sleeve, or the lining may be separate from the sleeve and attached adjacent to an outer surface of the sleeve, such that the interfacing surface of the lining interfaces the side surface of the inner cutter and the outer surface of the sleeve. The lining and sleeve may be brazed or attached by other methods known in the art to a cutter pocket formed on one of the plurality of blades. Further, the lining, sleeve, or combination of the lining and sleeve may be replaced, for example, if a component in the cutting element assembly has failed and needs replacement. For example, in embodiments having separate lining and sleeve components assembled together, the lining may be removed from the cutting element assembly and replaced with a new lining.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A drill bit, comprising:

a bit body having a plurality of blades extending radially therefrom, at least one blade of the plurality of blades including a cut-out having forming at least:

a cutter pocket at least partially defined by a side wall of the at least one blade; and a recess adjacent the cutter pocket and inset in the at least one blade relative to the cutter pocket;

a cutting element in the cutter pocket, at least a portion of the cutting element being brazed to the side wall; and a lining within the recess, the lining having an interfacing surface that interfaces with an outer surface of the cutting element.

2. The drill bit of claim 1, at least a portion of the lining being nearer a longitudinal axis of the cutting element than the side wall.

3. The drill bit of claim 1, the lining being brazed to the at least one blade within the recess.

4. The drill bit of claim 1, the cutting element including a cutter having a cutting face, a cutting end extending a distance from the cutting face, and a body, the interfacing surface of the lining interfacing with an outer circumferential surface of the cutting end of the cutter.

5. The drill bit of claim 4, the cutting element including a sleeve around at least a portion of the body of the cutter, the sleeve being brazed to the side wall.

6. The drill bit of claim 5, an outer surface of the sleeve being substantially radially aligned, relative to a longitudinal axis of the cutting element, with the interfacing surface of the lining.

7. The drill bit of claim 5, an outer surface of the sleeve being radially nearer or farther from a longitudinal axis of the cutting element than the interfacing surface of the lining.

8. The drill bit of claim 5, the cutter including a body having a body diameter, and a cutting end having a cutting end diameter, the body diameter being about the same as an inner diameter of the sleeve, and the cutting end diameter being about the same as an outer diameter of the sleeve.

9. The drill bit of claim 5, the lining positioned at a longitudinal, axial distance away from the sleeve.

10. The drill bit of claim 9, the longitudinal, axial distance between the lining and the sleeve being at least 0.02 inch.

11. The drill bit of claim 5, the cutting element including a retention mechanism between the sleeve and the body of the cutter, the retention mechanism axially retaining the cutter within the sleeve.

12. The drill bit of claim 4, the cutting end having a cutting end depth greater than a lining length.

13. A drill bit, comprising:

a bit body having a plurality of blades extending radially therefrom, a blade of the plurality of blades including a cut-out defining a cutter pocket;

a cutting element, the cutting element including:

a sleeve in the cutter pocket and attached to a side wall of the cut-out, the side wall defining at least a portion of the cutter pocket;

a cutter in the sleeve, the cutter having a cutting face, a cutting end, and a body; and a lining in the cut-out and coupled to the blade of the plurality of blades, the lining having an interfacing surface that interfaces with an outer surface of the cutting end of the cutter, the lining being separate from the cutting element and extending around less than an entire circumference of the cutting end of the cutter.

14. The drill bit of claim 13, the lining being a hardfacing layer or abrasive resistant coating applied to a side wall of the cutter pocket.

15. The drill bit of claim 13, the lining having a thickness of less than about 0.008 inch.

16. The drill bit of claim 13, the lining supporting only the cutting end of the cutter.

17. A drill bit, comprising:

a bit body having a plurality of blades extending radially therefrom, a blade of the plurality of blades including a cut-out defining a cutter pocket;

a cutting element in the cutter pocket;

wherein the cutting element comprising a sleeve attached to the cutter pocket with a braze material, the cutting element further including a cutter at least partially in the sleeve; and a lining in the cut-out and brazed to the cut-out and to the sleeve, the lining having an interfacing surface that interfaces with an outer surface of the cutting element.

18. The drill bit of claim 17, the cutting element comprising a sleeve attached to the cutter pocket with a braze material, the cutting element further including a cutter at least partially in the sleeve.

19. The drill bit of claim 18, further comprising:

a retention mechanism between the sleeve and a body of the cutter.

* * * * *